US009739457B2

(12) United States Patent
Breen, IV et al.

(10) Patent No.: US 9,739,457 B2
(45) Date of Patent: Aug. 22, 2017

(54) DEVICE FOR HOLDING A SOURCE OF LIGHT

(75) Inventors: Dennis M. Breen, IV, West Chicago, IL (US); Benjamin David Swedberg, Sycamore, IL (US); Alan Emad Zantout, Sycamore, IL (US); Matthew David Schroll, Glendale Heights, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 1130 days.

(21) Appl. No.: 13/309,675

(22) Filed: Dec. 2, 2011

(65) Prior Publication Data

US 2012/0305230 A1 Dec. 6, 2012

Related U.S. Application Data

(60) Provisional application No. 61/419,649, filed on Dec. 3, 2010, provisional application No. 61/547,382, filed on Oct. 14, 2011.

(51) Int. Cl.
*F21V 19/00* (2006.01)
*F21V 31/00* (2006.01)
(Continued)

(52) U.S. Cl.
CPC ..... *F21V 19/001* (2013.01); *F21V 19/0005* (2013.01); *F21V 23/006* (2013.01);
(Continued)

(58) Field of Classification Search
CPC ..... F21Y 2101/02; F21Y 2105/001; F21Y 2103/003; F21Y 2115/10;
(Continued)

(56) References Cited

U.S. PATENT DOCUMENTS 5,528,477 A * 6/1996 Carmo ..... 362/260
D602,868 S 10/2009 Vogt et al.
(Continued)

FOREIGN PATENT DOCUMENTS

DE 102008012472 A1 9/2009
DE 102009040115 A1 2/2011
(Continued)

OTHER PUBLICATIONS

The International Bureau of WIPO, International Preliminary Report on Patentability issued on PCT Appln. No. US2011/062996, mailed Jun. 13, 2013, 7 pages.
(Continued)

*Primary Examiner* — Stephen F Husar
(74) *Attorney, Agent, or Firm* — Greenberg Traurig, LLP

(57) ABSTRACT

An assembly includes a light source holding component sized and arranged to securely receive a source of light. The light source holding component may include a displaceable protective device that functions to generally protect against an accidental touching of electrical terminals of the light source holding component. An accessory mounting feature may also be provided to the light source holding component, The accessory mounting feature is adapted to cooperate with an accessory to provide a seal against a surface to which the light source holding component is attached. The light source holding component may have wire ports that are formed within an overall general outer diameter of the light source holding component. By way of example, the wire ports may include wire contacts having wires pre-attached thereto or the wire ports may include electrical connectors of the push-in type for receiving and thereupon holding wires inserted therein.

10 Claims, 26 Drawing Sheets

(51) Int. Cl.

| | |
|---|---|
| ***H01R 13/453*** | (2006.01) |
| ***F21V 29/77*** | (2015.01) |
| *F21V 23/00* | (2015.01) |
| *F21V 25/02* | (2006.01) |
| *F21V 27/02* | (2006.01) |
| *H01R 33/46* | (2006.01) |
| *F21V 29/83* | (2015.01) |
| *F21Y 115/10* | (2016.01) |

(52) U.S. Cl.
CPC ..... *F21V 29/773* (2015.01); *F21V 31/005* (2013.01); *H01R 13/4532* (2013.01); *F21V 23/002* (2013.01); *F21V 25/02* (2013.01); *F21V 27/02* (2013.01); *F21V 29/83* (2015.01); *F21Y 2115/10* (2016.08); *H01R 33/46* (2013.01)

(58) Field of Classification Search
CPC .. A61B 17/12104; F21L 4/00; F21V 29/2293; F21V 19/001; F21V 29/773; F21V 23/004; F21V 19/0005; F21V 31/005; F21V 29/83; F21V 23/002; F21V 27/02; F21V 25/02; F21V 23/006; H05B 33/0803; B01L 2200/0684; H04M 1/0277; H05K 2201/10106; A01M 29/10; B60K 11/06; H01R 13/4532; H01R 33/46
USPC ..... 348/207.99; 257/5; 200/81 H; 236/49.3; 362/249.01, 119, 249, 302, 294, 373
See application file for complete search history.

(56) References Cited

U.S. PATENT DOCUMENTS

| | | | | |
|---|---|---|---|---|
| D602,869 | S | 10/2009 | Vogt et al. | |
| 7,686,483 | B1 * | 3/2010 | Aubrey | F21V 13/04 362/147 |
| D627,296 | S | 11/2010 | Vogt et al. | |
| 7,832,899 | B2 | 11/2010 | Zheng | |
| 2001/0022342 | A1 * | 9/2001 | Wirthlin | 250/229 |
| 2004/0228124 | A1 * | 11/2004 | Reiff et al. | 362/184 |
| 2009/0059064 | A1 | 3/2009 | Terakado | |
| 2009/0086476 | A1 | 4/2009 | Tickner et al. | |
| 2010/0020548 | A1 | 1/2010 | Tyson et al. | |
| 2010/0087100 | A1 | 4/2010 | DeBlieck et al. | |
| 2010/0290236 | A1 | 11/2010 | Gingrich, III et al. | |

FOREIGN PATENT DOCUMENTS

| | | | |
|---|---|---|---|
| EP | 0818856 | A1 | 1/1998 |
| EP | 0933839 | A2 | 8/1999 |
| EP | 2 284 440 | | 2/2011 |
| GB | 2304239 | A | 3/1997 |
| JP | 9320327 | | 12/1997 |
| JP | 11066941 | | 3/1999 |
| JP | 2007005193 | | 1/2007 |
| WO | WO 2009/112391 | | 9/2009 |
| WO | WO 2011/015166 | | 10/2011 |
| WO | WO 2011/015168 | | 10/2011 |

OTHER PUBLICATIONS

European Patent Office, Extended European Search Report issued on European patent application No. 11844725.9, 8 pages.
European Patent Office, Office Action issued on European patent application No. 11844725.9, dated Jul. 31, 2015, 7 pages.
Chinese Patent Office, Office Action issued on Chinese patent application No. 201180062772.2, dated Jul. 3, 2015, 10 pages.
Chinese Patent Office, Office Action issued on Chinese patent application No. 201180062772.2, dated Jan. 5, 2015, 3 pages.
Chinese Patent Office, Notification issued on Chinese patent application No. 201180062772.2, dated Oct. 31, 2014, 1 page.

* cited by examiner

DEVICE FOR HOLDING A SOURCE OF LIGHT

RELATED APPLICATION

This application claims the benefit of U.S. Provisional Application No. 61/419,649, filed on Dec. 3, 2010, and U.S. Provisional Application No. 61/547,382, filed on Oct. 14, 2011, the disclosures of which are incorporated herein in their entirety.

BACKGROUND

Devices for holding a source of light, e.g., a LED light engine or a LED light module, are known in the art. By way of example, prior art FIGS. 1A and 2 illustrate a luminaire assembly which includes a light source holding component (shown in FIG. 1B) having wire ports that are formed in a projection where the projection extends outwardly from the light source holding component of the device in a radial direction beyond the diameter of the device, i.e., the projection is outside of an overall general diameter of the light source holding component. As will be appreciated, light source holding components constructed in this manner suffer, among various disadvantages, the disadvantages of: 1) having a relatively large geometry as a result of failing to provide wire ports that are located within a general overall diameter of the light source holding component; and 2) failing to allow for wires to be fed directly to a junction box from the wire ports without the use of further wire carrying conduit.

SUMMARY

Described hereinafter are improved devices for holding a source of light, particularly as a source of LED light, which overcome the various disadvantages seen with existing devices and which provide further advantages that will be appreciated by those of ordinary skill in the art.

More particularly, and by way of non-limiting example, the following describes an exemplary light source holding component having associated wire ports wherein the wire ports are located within the general overall diameter of a light source holding component. Further, these wire ports may be oriented so as to allow wires to exit in two planes from the light source holding component, namely, radially from the light source holding component and axially from the light source holding component. When axially extended, the wires may be fed directly from the light source holding component to a junction box through a heat sink having an integrated, enclosed wire pathway thus eliminating the need for extra wire carrying conduit.

Yet further, a heat sink is described that may itself be provided with an integrated junction box to thereby reduce the part count of the device.

Still further, a light source holding component (whether round, rectangular, or other shape that might be specified by a standards organization) is described that may be associated with wire port openings having different sizes to thereby prevent an installer from placing a power wire, having a first size, into a wire port intended for receiving a control wire (e.g., used to provide lamp dimming signals or the like) having a second size that is smaller than the first size.

Additionally, a light source holding component assembly is described that may include one or more wire spring forms that are positioned around an interior perimeter thereof to provide a compression force between the source of light and a heat sink to thereby ensure a good heat dissipating relation between the two components.

Yet further, an assembly is described which includes a circuit board that may also be positioned within the light source holding component to provide a circuit pathway between the terminals connected to the source of light and the wire ports. Such a circuit board could then carry control and/or power electronic components that would otherwise be included with, for example, an LED light engine and/or remote electrical control gear.

Still further, a light source holding component is described that may be provided with an accessory mounting feature. The accessory mounting feature may be arranged to cause an accessory mounted thereto, e.g., a device carrying a lens, a metal enclosure, etc., to seal and thereby protect the electrical components associated with the light source holding component and the source of light held therein from dust, moisture, or the like.

Yet further, a light source holding component is described that may be provided with a protective device to prevent accidental touching of the electrical contacts that are carried thereby.

Still further, a light source holding component is described having ventilation channels to provide cooling.

While the foregoing provides a general description of the subject devices for holding a source of light and some advantages thereof, a better understanding of the objects, advantages, features, properties, and relationships of the subject devices will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described devices for holding a source of light, reference may be had to the following drawings in which.

DETAILED DESCRIPTION

Figure 1B:
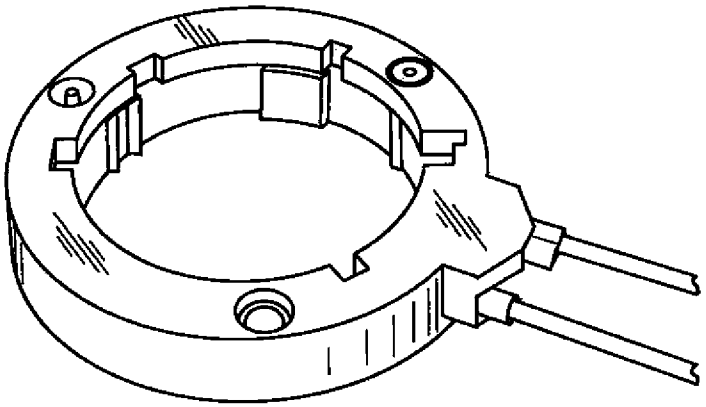
FIGS. 1A, 1B, and 2 illustrate an exemplary prior art assembly including a light source holding component for holding a source of light, particularly a source of LED light.
Figure 1A:
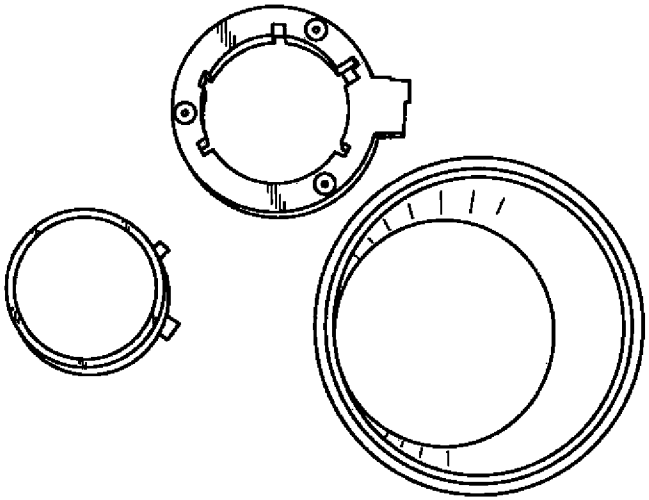
Figure 2:
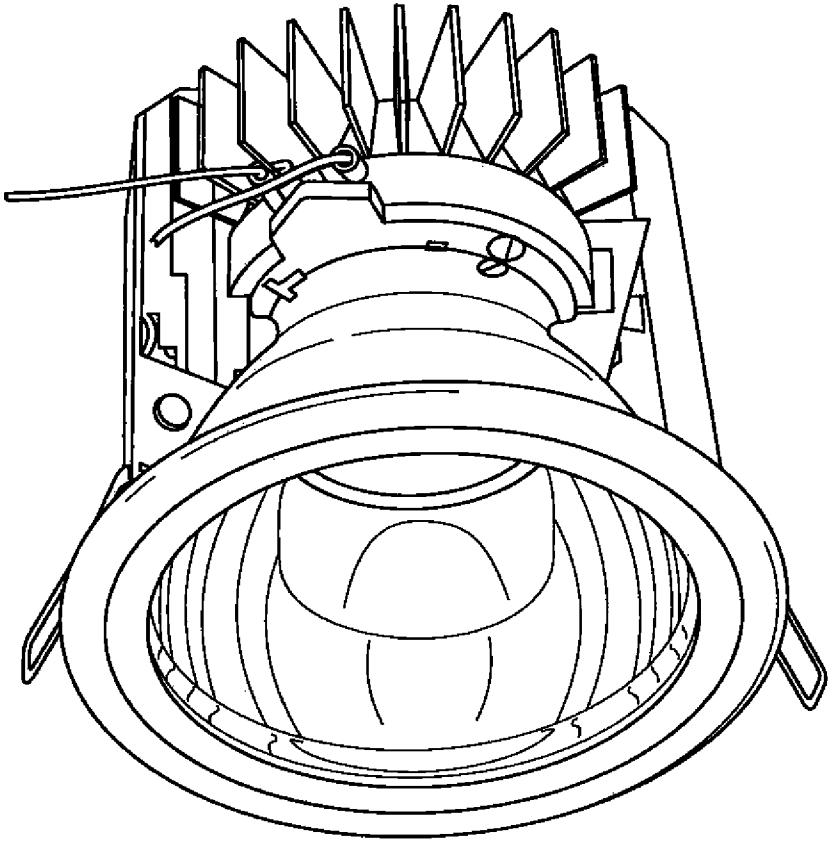
Figure 3:
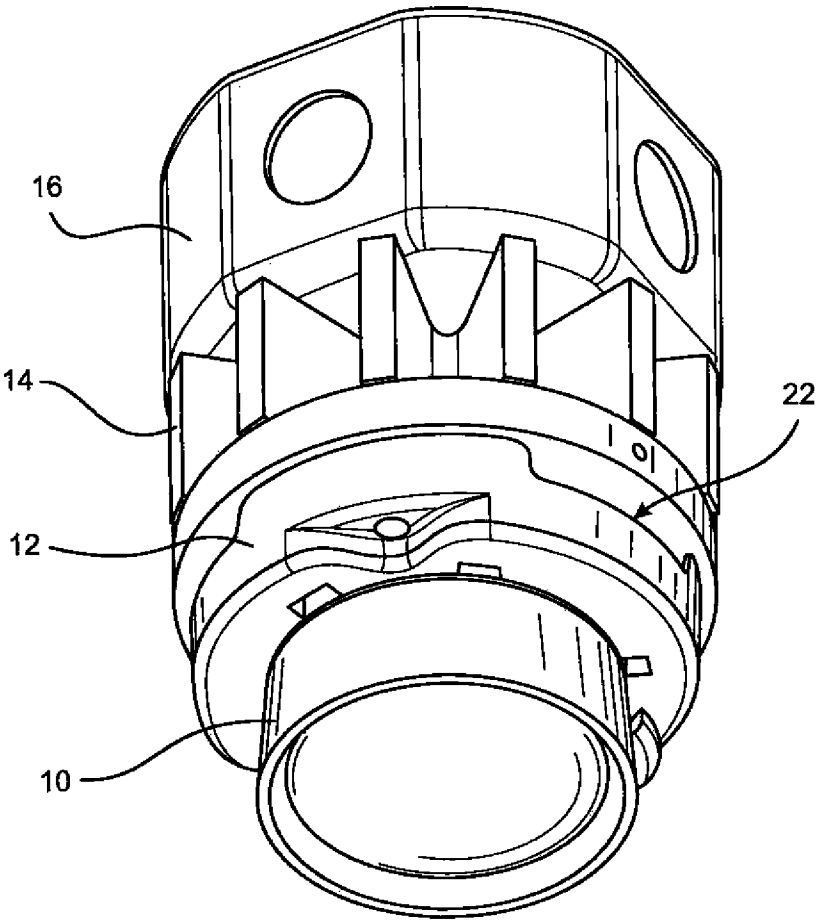
FIGS. 3-5 illustrate an exemplary assembly including a light source holding component constructed according to the description that follows
Figure 4:
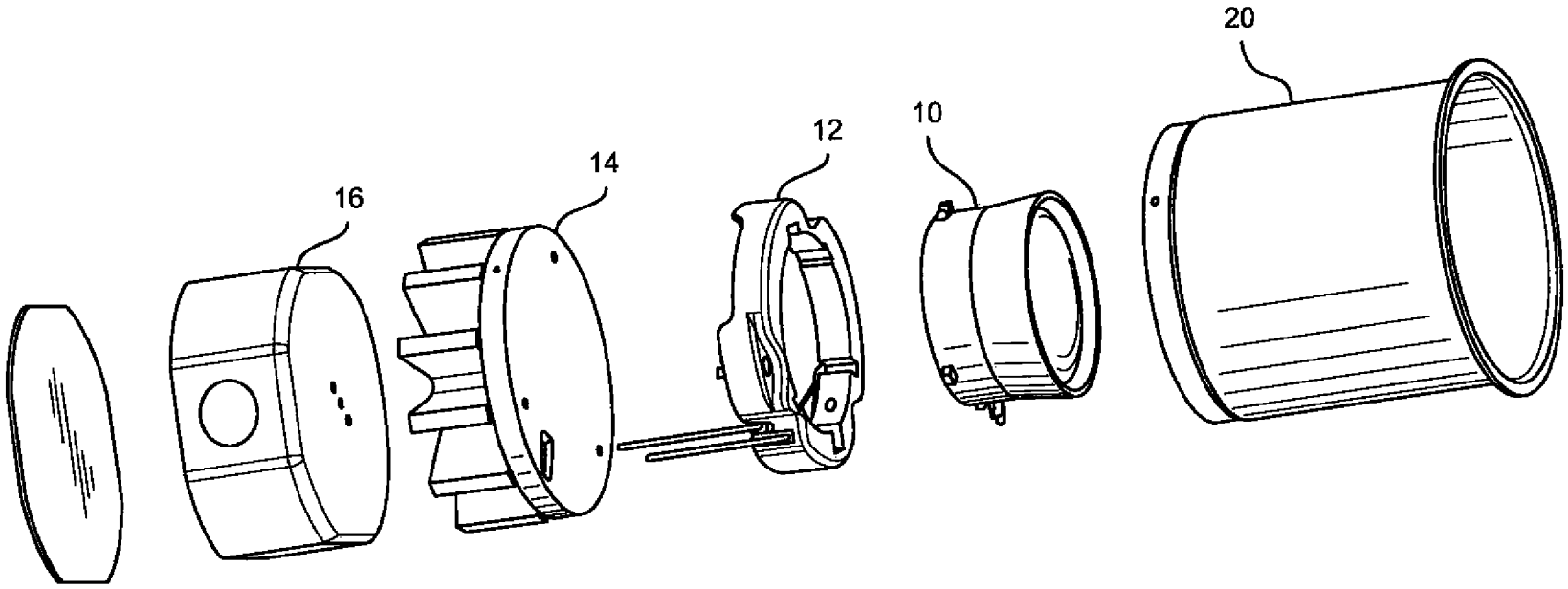
Figure 5:
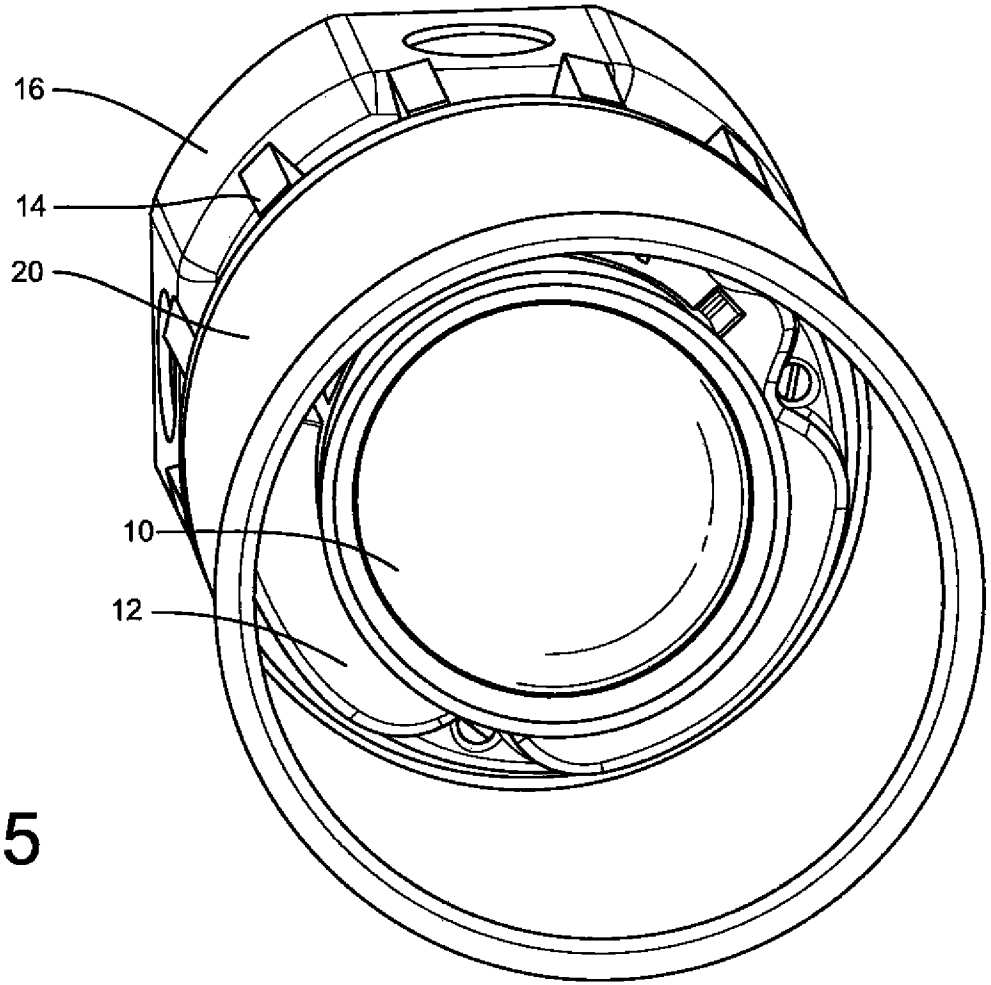

Turning now to the Figures, illustrated are various embodiments of various components that are usable to construct an assembly for holding a source of light, particularly a source of LED light such as a LED light engine or a LED light module. By way of example, FIGS. 3-5 illustrate an assembly for holding a source of light 10 comprised of a light source holding component or socket 12 which may be further attached to a heat sink 14 and an electrical junction box 16. While not limiting, the assembly may further include a can enclosure 20 such as commonly used in overhead lighting fixtures.

Figure 6B:
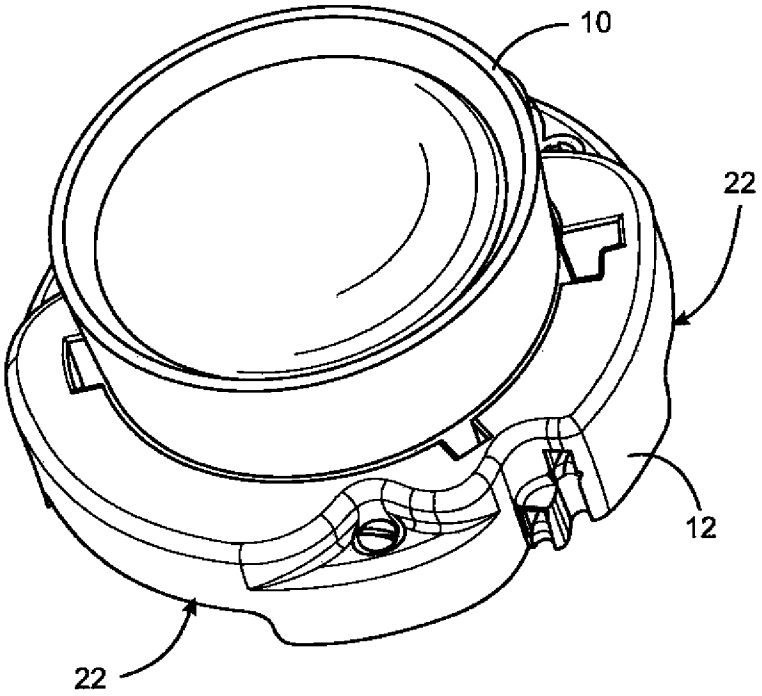
FIG. 6B illustrates a light source holding component constructed according to the description that follows with an installed source of light.
Figure 6A:
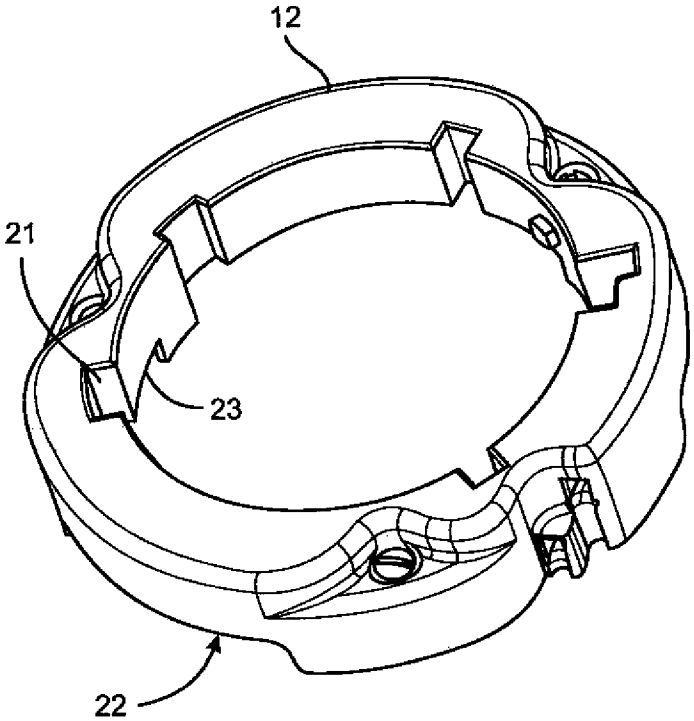
FIG. 6A illustrates a light source holding component constructed according to the description that follows without a source of light installed therein.
Figure 18:
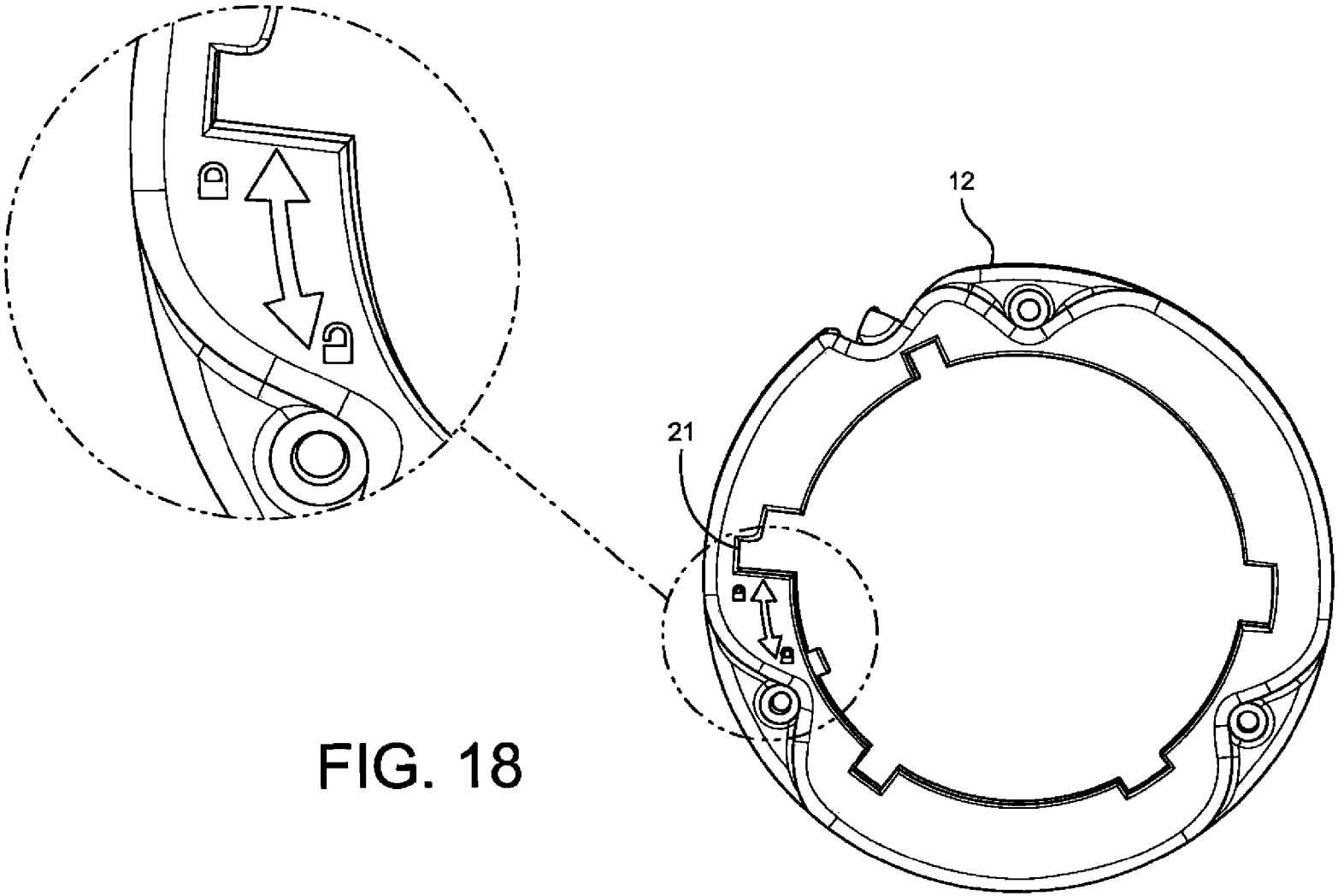
FIG. 18 illustrates a light source holding component having instructions for servicing a source of light molded thereon.

As shown in FIGS. 6A and 6B, the light source holding component 12 of such an assembly is sized and arranged to receive and then securely hold a source of light 10 of conventional and/or standardized construction. In this regard, the light source holding component 12 and source of light 10 may be provided with cooperable mechanical elements that allow the source of light 10 to be twist fit or otherwise moved into engagement with the light source holding component 12. For example, the source of light 10 may include tangs or the like which would be received into openings 21 formed in the light source holding component 12 after which the source of light 10 would be twisted relative to the light source holding component 12 to lock or capture such tangs under a surface feature 23 formed in the light source holding component 12. To this end, as further illustrated in FIG. 18, the light source holding component 12 may have molded thereon graphical instructions for instructing a user in the manner or direction in which to twist or otherwise move the source of light 10 relative to the light source holding component 12 to thereby lock the source of light 10 with the light source holding component 12 and the manner or direction in which to twist or otherwise move the source of light 10 relative to the light source holding component 12 to thereby unlock or free the source of light 10 from its locked position.

As further illustrated in FIGS. 3, 6A, and 6B, the light source holding component 12 may also be provided with spaces or windows 22 to thereby form one or more passageways by which air can access the heat sink 14 for heat dissipation purposes when the source of light 10 is inserted into the light source holding component 12. In the example illustrated in FIGS. 3 and 6, such windows 22 are in the form of channels that are formed in the bottom of the light source holding component 12. It will be appreciated, however, that other forms of heat dissipating, air flow passageways can be provided to the light source holding component 12 and, as such, the illustrated channels 22 are not intended to be limiting.

Figure 7B:
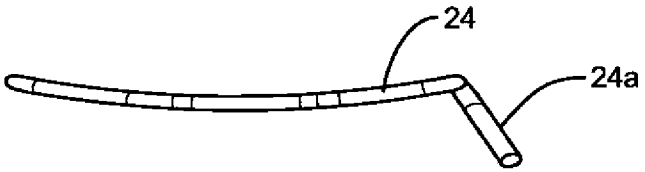
FIG. 7B illustrates a spring device usable in connection with the light source holding component constructed according to the description that follows.
Figure 7A:
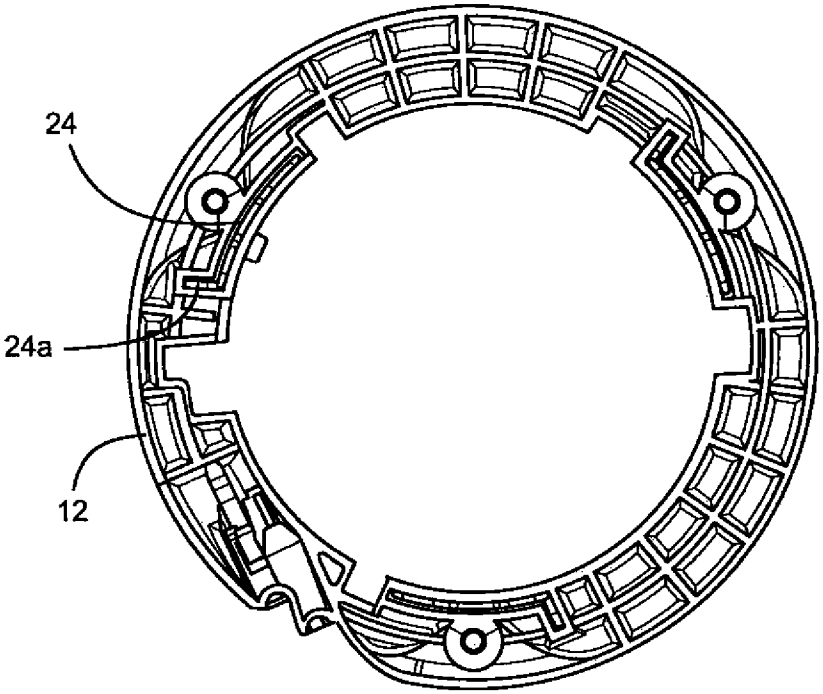
FIGS. 7A and 10 illustrate an underside of a light source holding component constructed according to the description that follows.
Figure 8:
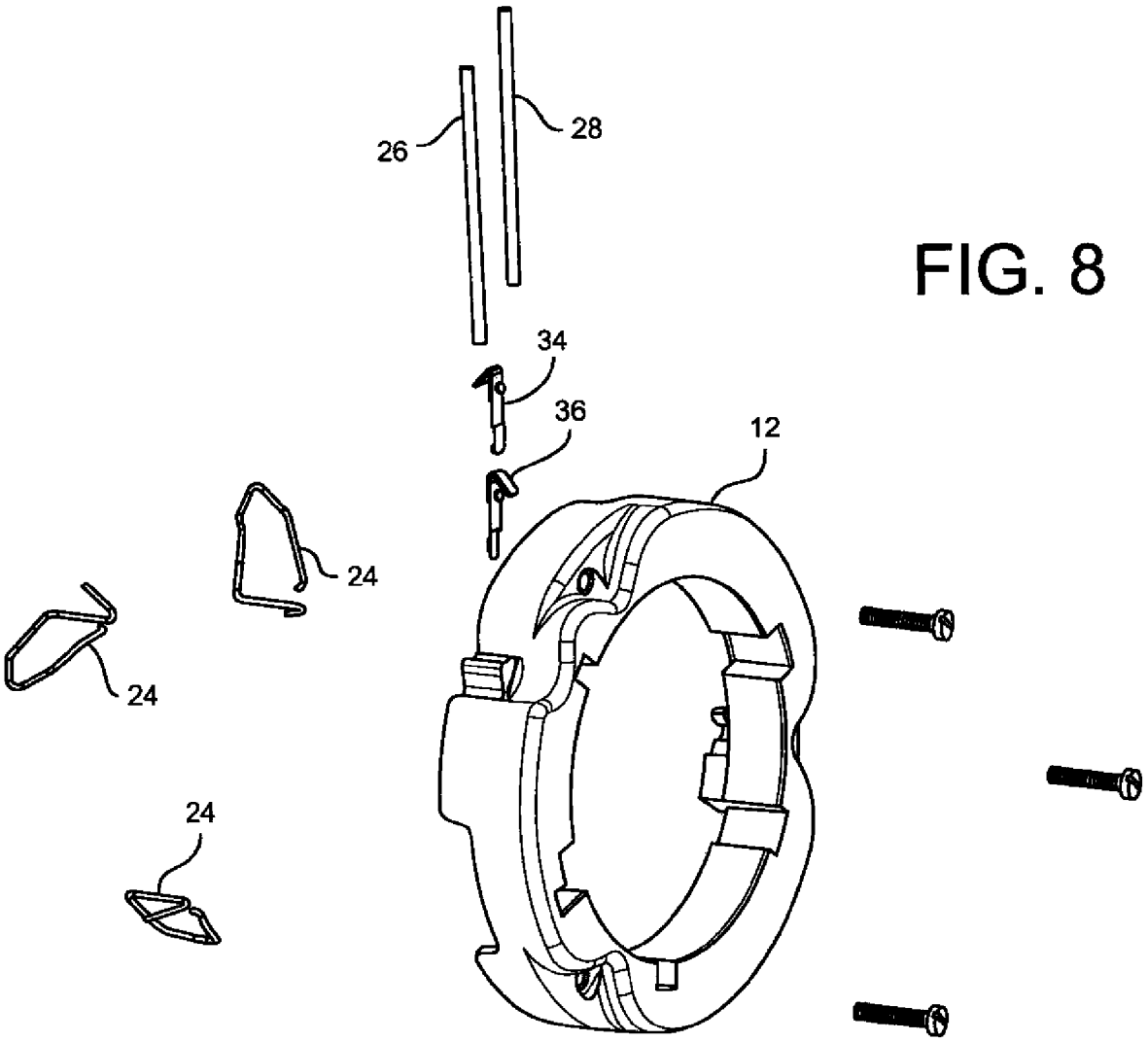
FIG. 8 illustrates an exploded view of a light source holding component assembly constructed according to the description that follows.

For maintaining a compression fit between a source of light 10 inserted into the light source holding component 12 and a heat sink 14 attached to an underside of the light source holding component 12 (attached for example via use of screws or the like) to thereby ensure good heat dissipating contact between the source of light 10 and the heat sink 14, the light source holding component 12 may be provided with one or more wire spring forms 24. As illustrated in FIGS. 7A, 7B, and 8, the wire spring form(s) 24 are preferably positioned along an interior perimeter of the light source holding component 12 to thereby exert a generally downward force upon the source of light 10. As will be understood, the use of such wire spring form(s) 24 will allow the light source holding component 12 to have an overall smaller footprint as opposed to a light source holding component 12 that uses compression springs, stamped leaf springs, or the like for this same purpose.

Figure 19:
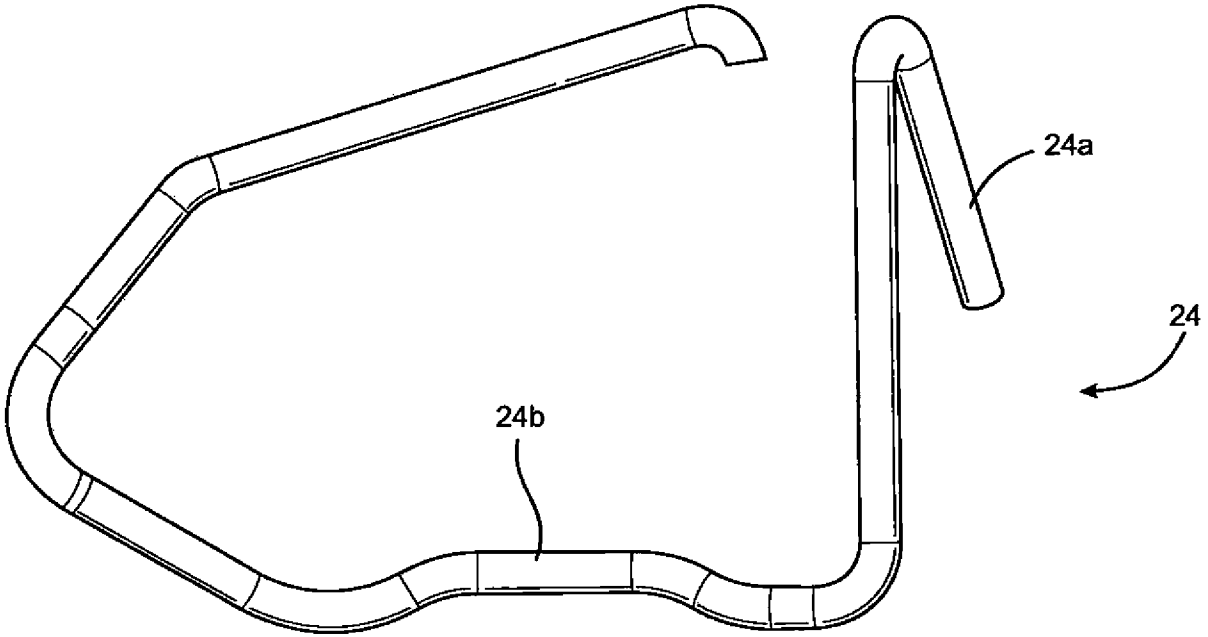
FIG. 19 illustrates an exemplary wire spring form usable in connection with a light source holding component constructed according to the description that follows.
Figure 20:
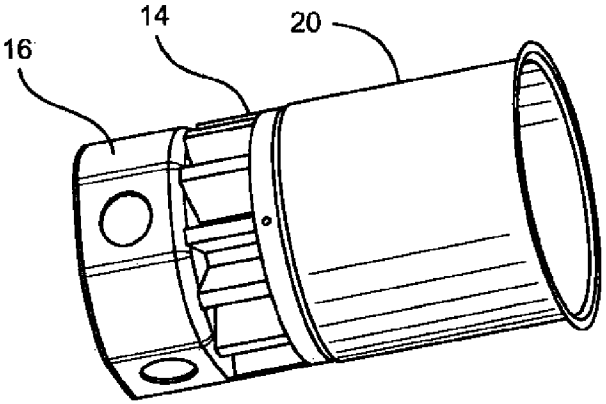
FIGS. 20-23 illustrate a further exemplary assembly including a light source holding component which provides an accessory mounting feature that is arranged to provide a sealing function constructed according to the description that follows.
Figure 21:
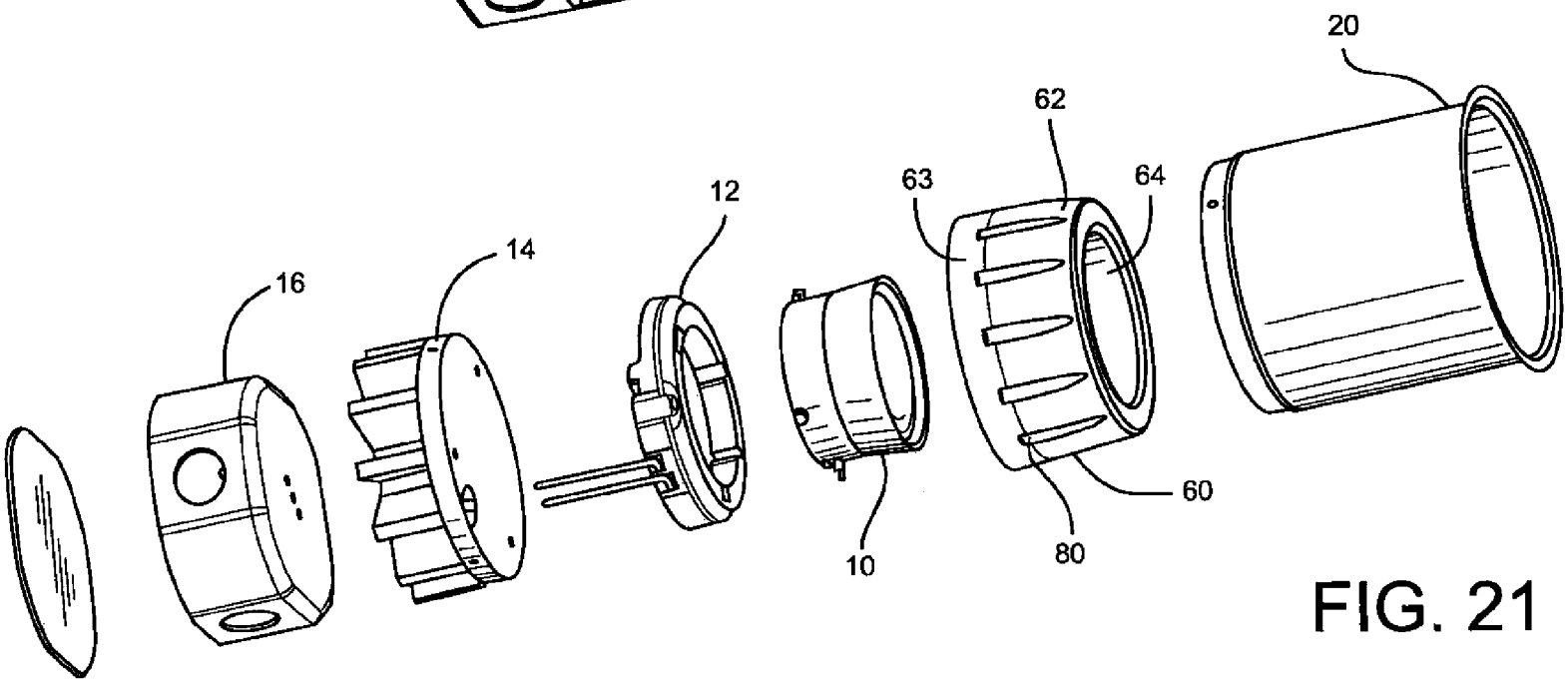

As further illustrated in FIG. 7A, the underside of the light source holding component 12 would include a corresponding number of cavities for holding the wire spring forms(s) 24 in the desired position(s). To this end, the wire spring form(s) 24 may be provided with legs 24*a* which are intended to be inserted into corresponding leg accepting forms formed in the light source holding component 12 as illustrated in FIGS. 7A and 19. As additionally illustrated in FIG. 19, the wire spring form(s) 24 are further formed to provide a detent area 24*b* which is arranged so as to be deflectable by a locking component of the source of light 10 when the source of light 10 is moved into the locked position. As will be appreciated, after the locking component of the source of light 10 passes through the detent area 24*b* of the wire spring form(s) 24, the detent area 24*b* will serve to assist in maintaining the locking component of the source of light 10 in such locked position while the wire spring form(s) 24 provide an axial compression force upon the source of light 10 to thereby ensure good heat dissipating contact between the source of light 10 and the heat sink 14.

Figure 9B:
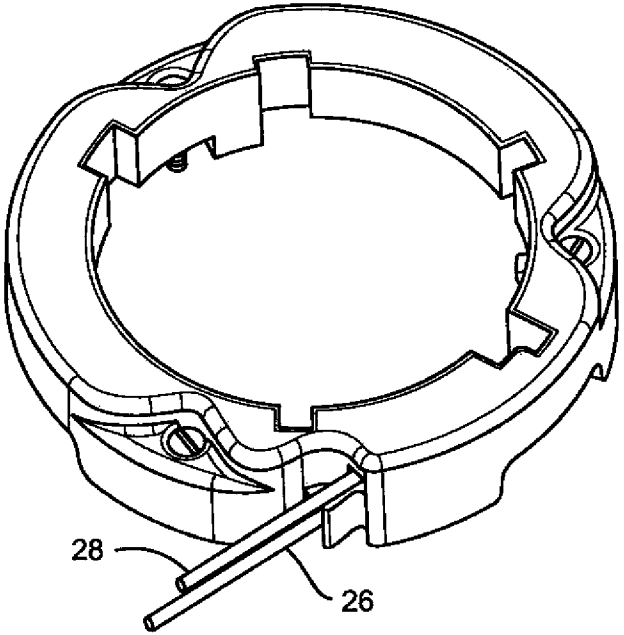
FIGS. 9A and 9B illustrate wire orientations that may be accommodated by a light source holding component constructed according to the description that follows.
Figure 9A:
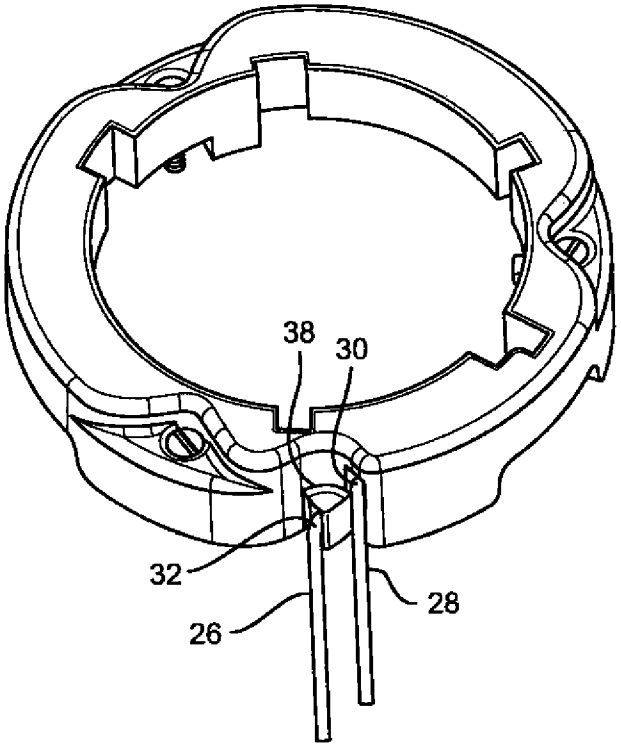
Figure 10:
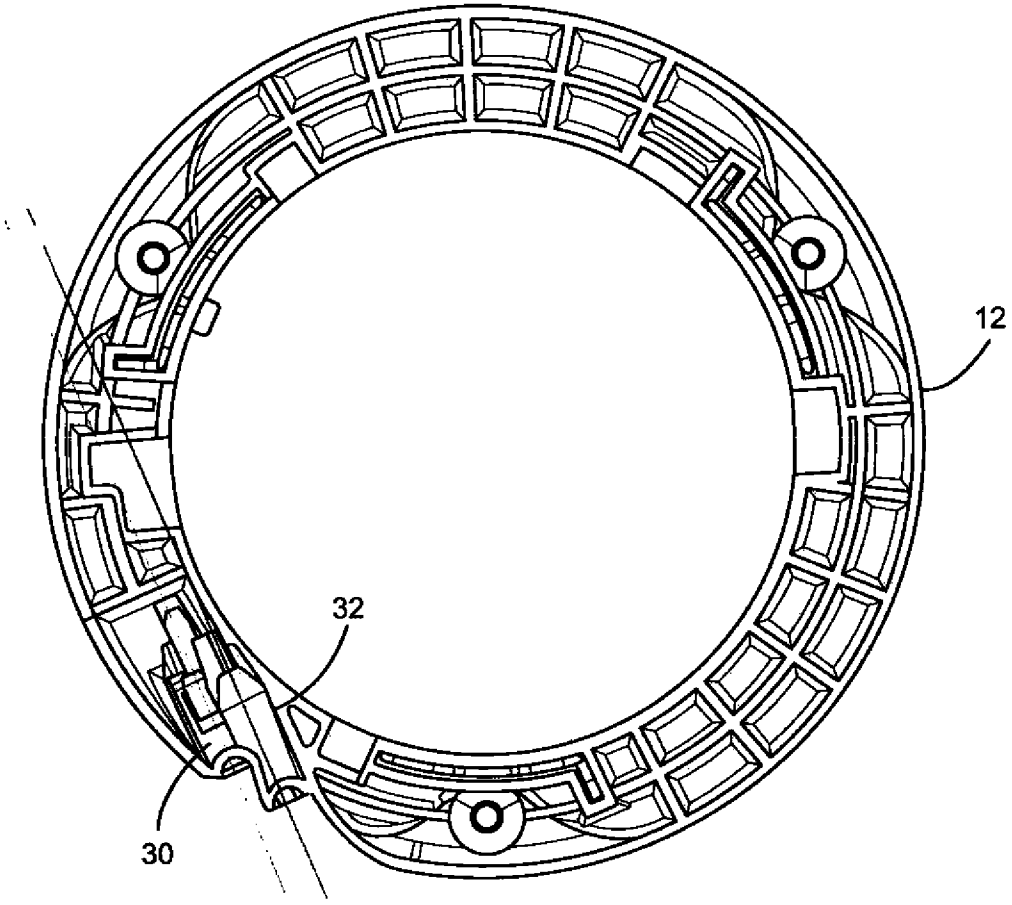
Figure 11:
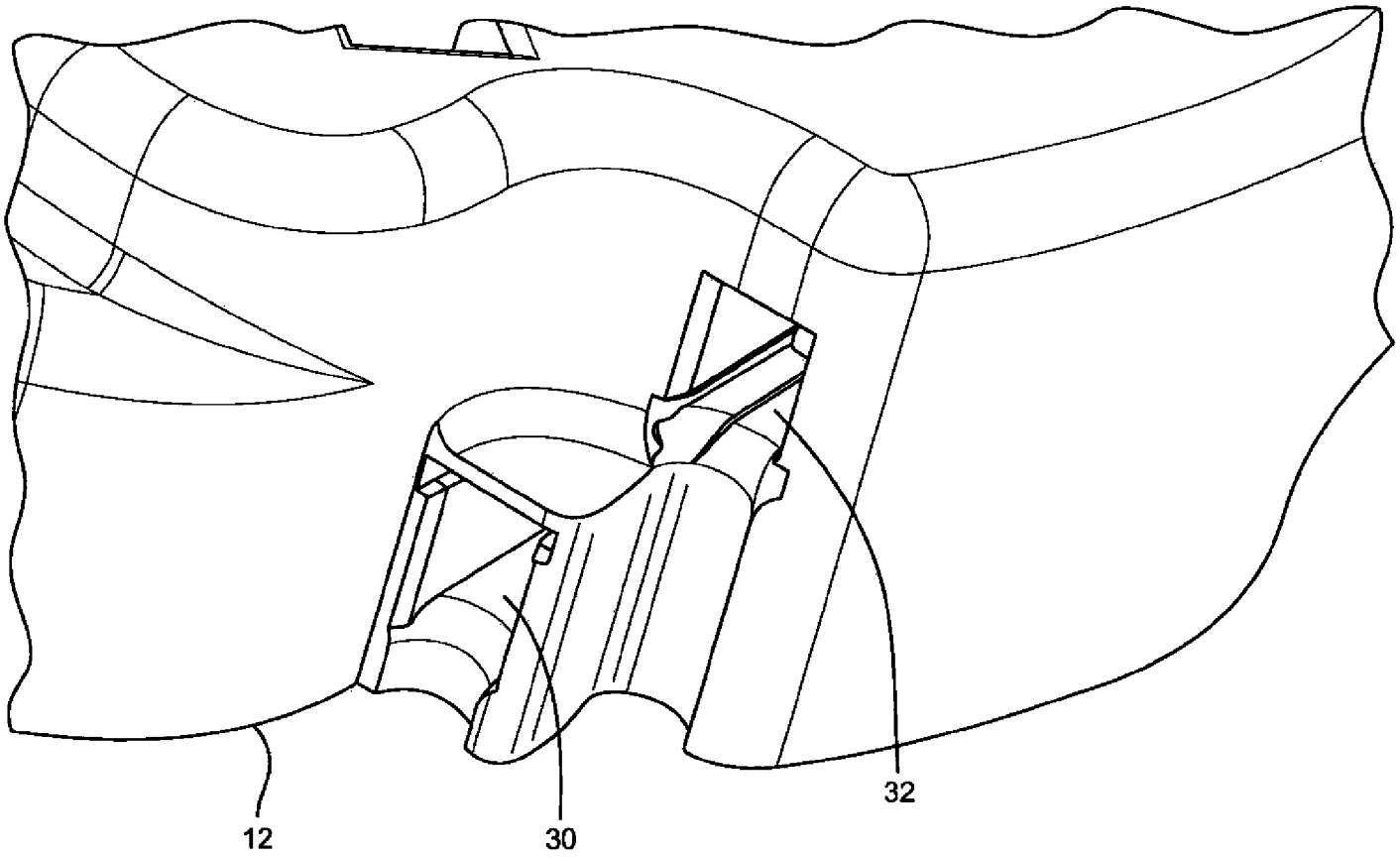
FIGS. 11 and 12 illustrate a close-up view of wire receiving ports associated with a light source holding component constructed according to the description that follows.
Figure 12:
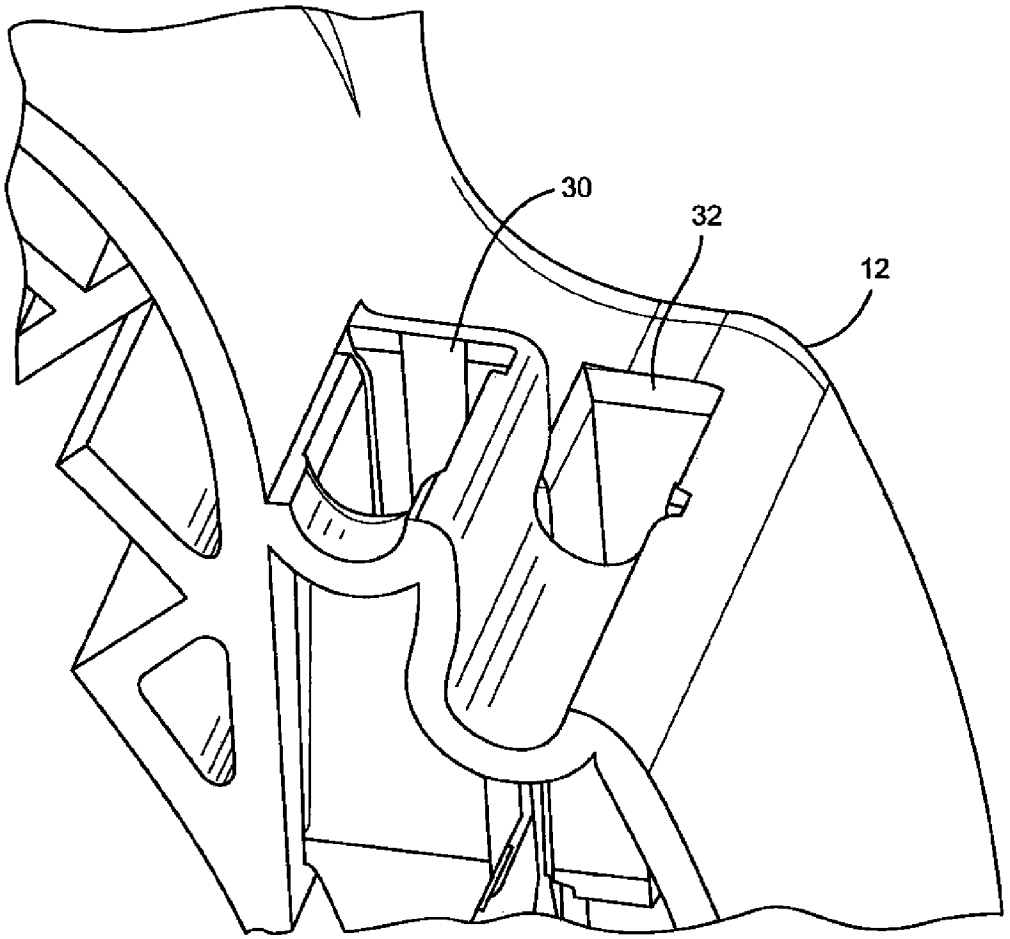

To provide power to the source of light 10, the light source holding component 12 is associated with wire ports 30, 32 in which are disposed wire contacts 34, 36 as illustrated in FIGS. 8, 9A, 9B, and 10-12. The wire contacts 34, 36 can include wires 26, 28 that are integrally attached thereto, can be of the push-in type variety of electrical contacts 34, 36 for receiving and thereupon capturing wires 26, 28, or the like without limitation. The wire contacts 34, 36 are also preferably arranged and positioned within the light source holding component 12 so as to directly engage corresponding electrical contacts provided to the source of light 10 when the source of light 10 is locked into position within the light source holding component 12. However, as described in greater detail hereinafter, it will be appreciated that further circuitry could be provided within the light source holding component 12 between the wire contacts 34 and 36 and the contacts provided to the source of light 10. In either case, the wire ports 30, 32 are preferably positioned relative to a portion 38 of the light source holding component 12 that is inwardly disposed relative to the general outer diameter of the light source holding component 12, i.e., the wire ports 30, 32 are positioned within the general outer diameter of the light source holding component 12. To facilitate such compact construction, the wire ports 30, 32 and corresponding electrical contacts 34, 36 are preferably arranged so as to extend inwardly in a direction that is tangential to circles that would be located between the inner overall diameter and outer overall diameter of the light source holding component 12 as illustrated in FIG. 10. In this manner, as shown in FIGS. 9A and 9B, the wires 26, 28 may be extended from the wire ports 30, 32 in a direction that is tangentially outward from the light source holding component 12 (for example when the device is to be used in Europe as shown in FIG. 9B) or axially downward within the outer overall diameter of the light source holding component 12 (for example when the device is to be used in the US or Canada as shown in FIG. 9A). To prevent wire chaffing when such wires 26, 28 are to be bent axially downward, the bottom edges of the offsetly positioned wire ports 30, 32 may be provided with curved or rounded edges leading to formed grooves as shown in FIGS. 11 and 12.

Figure 13B:
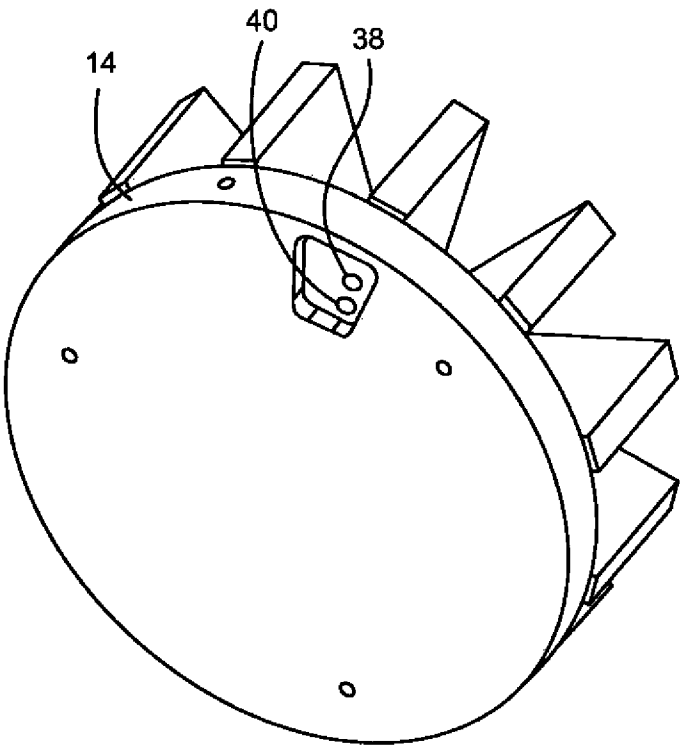
FIGS. 13A and 13B illustrate a heat sink usable in connection with a light source holding component constructed according to the description that follows.
Figure 13A:
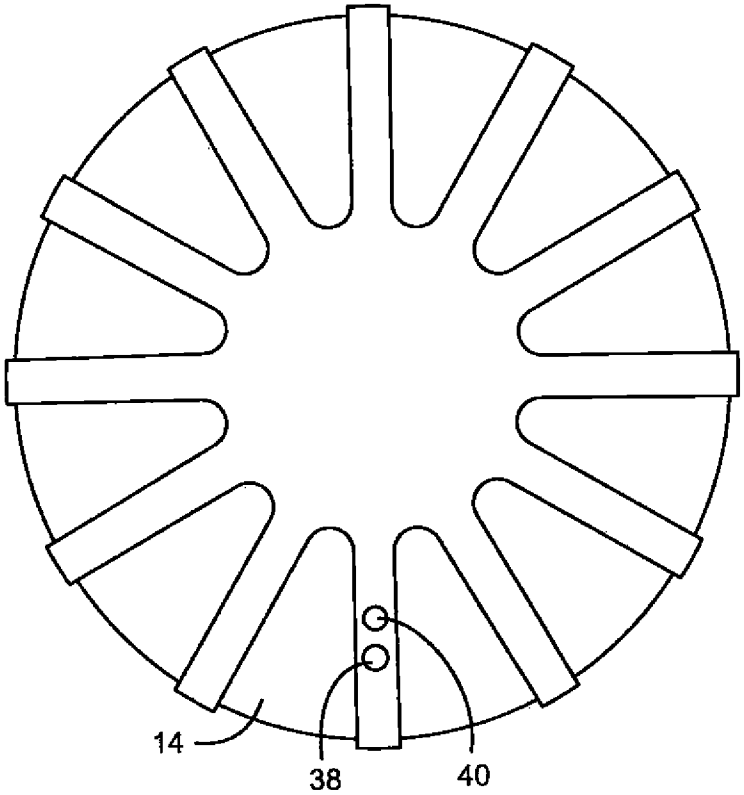

To eliminate the need for extra wire carrying conduit (particularly when an assembly is to be used in the US or Canada with the wires leading to a junction box in accordance with the codes thereof), the heat sink 14 may be provided with one or more integrally formed wire pathways 38, 40 which lead from a first end of the heat sink 14, that would be positioned adjacent to the light source holding component 12, to a second end of the heat sink 14, that would be positioned adjacent to a junction box as shown in FIGS. 3 and 13. As will be appreciated, the openings for the wire pathways 38, 40 would be positioned on the heat sink 14 so as to align with the wire ports 30, 32 (or formed grooves extending therefrom if provided) when the heat sink 14 is attached to the light source holding component 12. Still further, an area around the openings leading to the wire pathways 38, 40 can be milled out to allow for easier routing of the wires 26, 28 into the wire pathways 38, 40 as shown in FIGS. 13A and 13B.

Figure 14B:
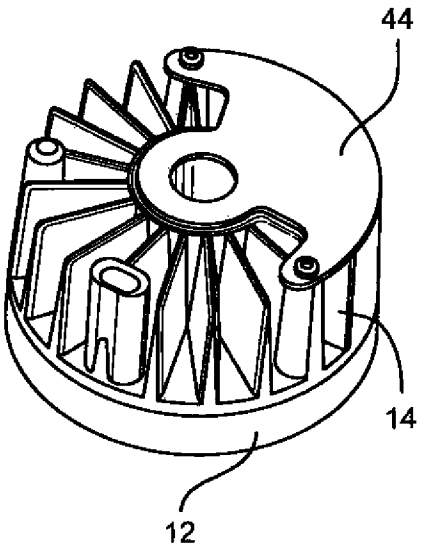
FIGS. 14A, 14B, and 15 illustrate a second heat sink usable in connection with a light source holding component constructed according to the description that follows.
Figure 14A:
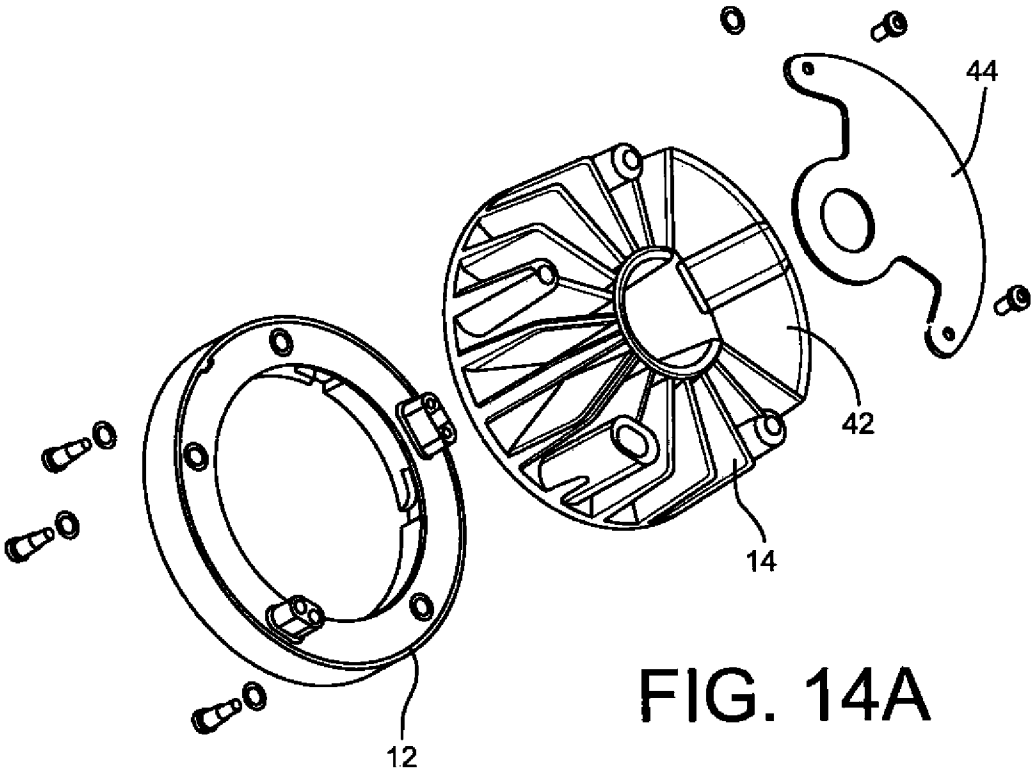
Figure 15:
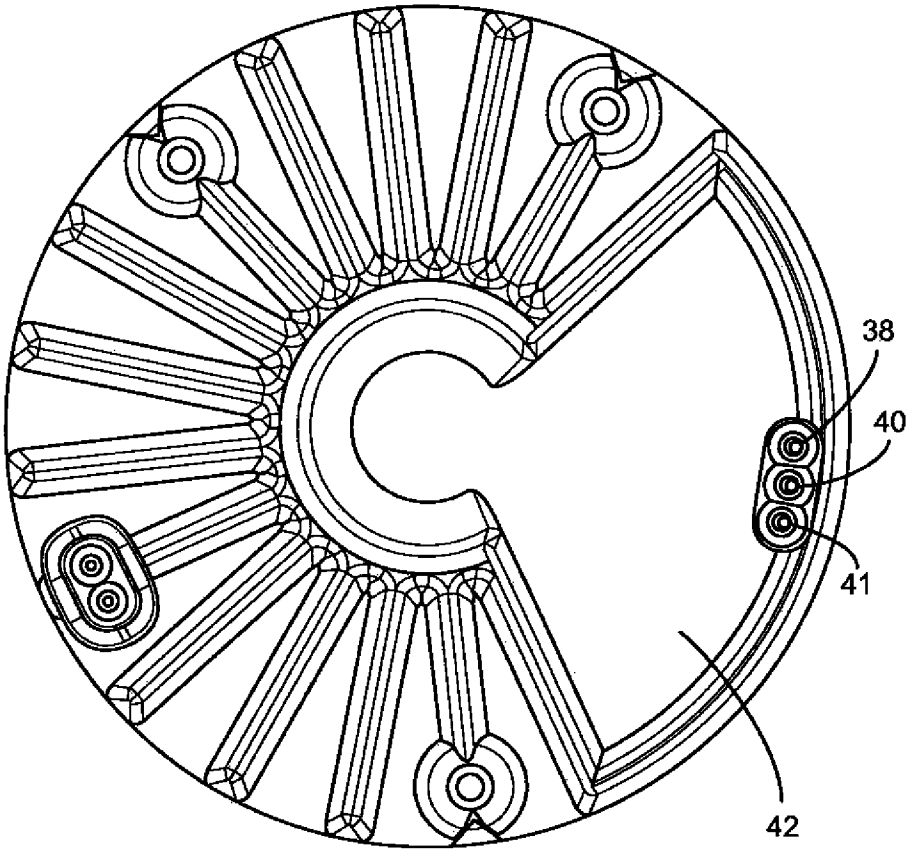

In an alternative arrangement of components for holding a source of light 10, illustrated in FIGS. 14A, 14B, and 15, the wire pathways 38, 40 (and others if needed, such as wire pathway 41 illustrated in FIG. 15) may lead to a junction box cavity 42 that is formed within the heat sink 14 itself. In such an arrangement, a detachable cover 44 would also be provided for use in covering the junction box cavity 42 of the heat sink 14. It will be appreciated that, in some instances, the junction box cavity 42 may be arranged to provide a single opening of desired size in lieu of plural wire pathways 38, 40, etc. by which the wires 26,28 can be fed directly into the junction box cavity 42 of the heat sink 14.

Figure 16B:
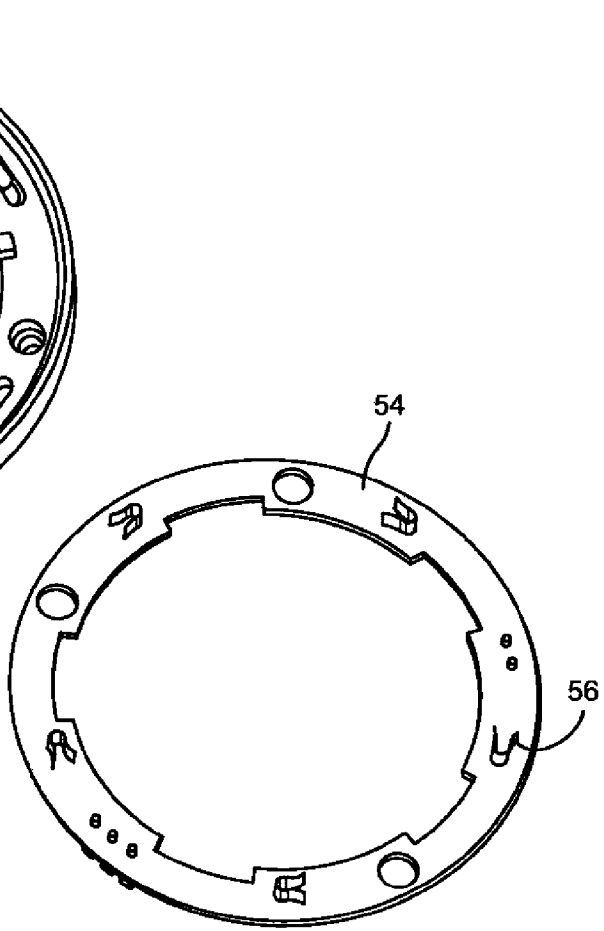
FIGS. 16A and 16B illustrate a light source holding component and a circuit board constructed according to the description that follows.
Figure 16A:
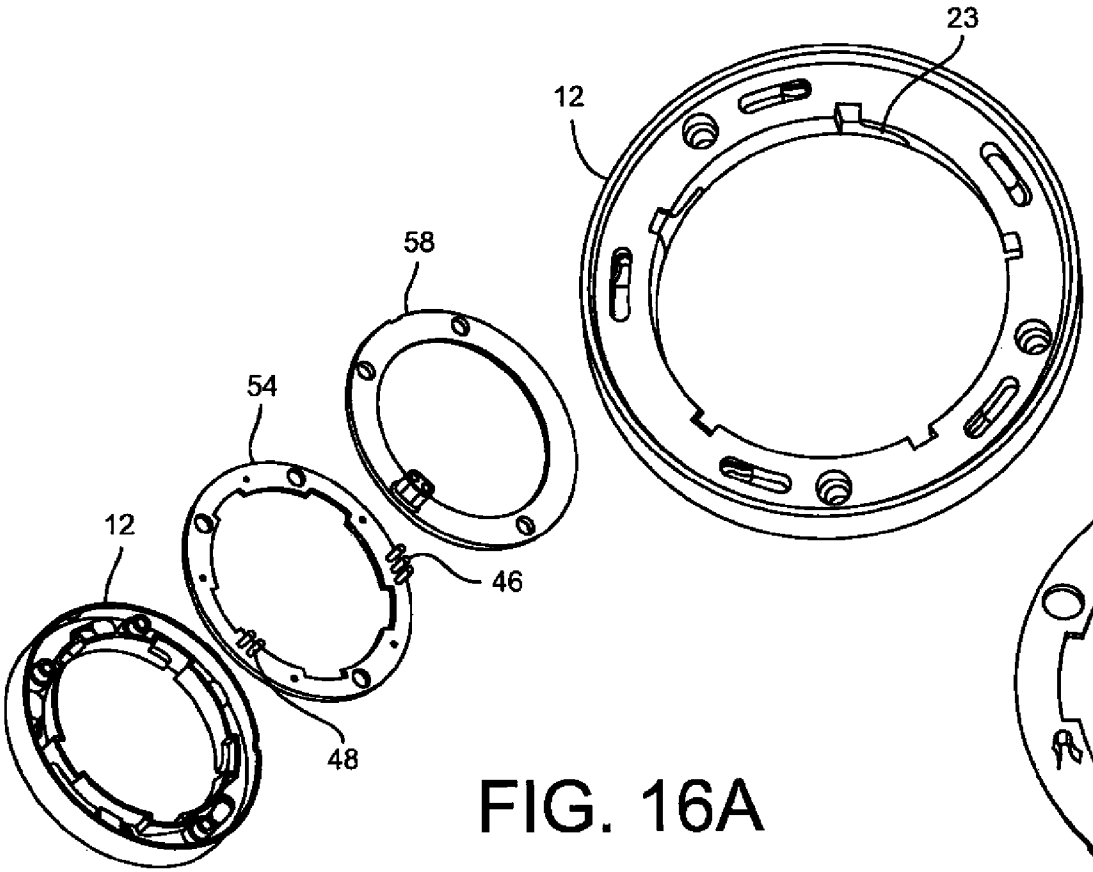
Figure 17:
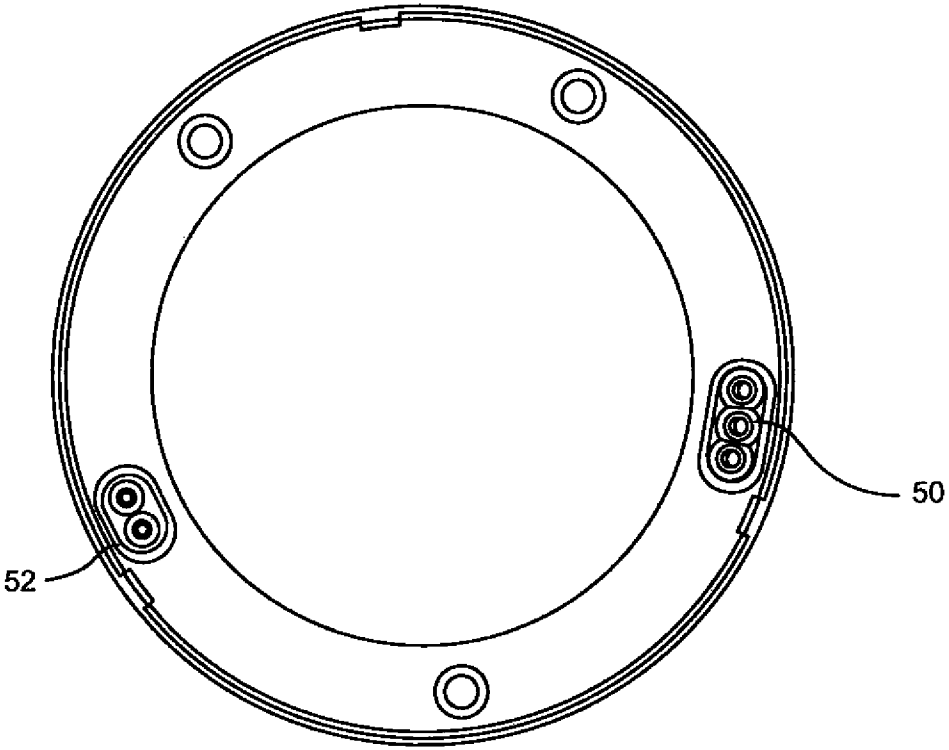
FIG. 17 illustrates an underside view of a light source holding component constructed according to the description that follows.

In a further embodiment of the light source holding component 12 shown in FIGS. 16A, and 17, downward, axially extending electrical wire ports 50 and 52 are associated with the light source holding component 12 in lieu of the tangentially oriented wire ports 30, 32 above described. In this regard, the wire ports 50 and 52 may include electrical wire contacts having pre-attached wires, may include electrical wire contacts of the push-in type variety for receiving and then capturing wires, such as wires for hot, neutral, and ground 46 and for control 48—if applicable. While not required, in this illustrated embodiment the light source holding component 12 additionally carries a circuit board 54, such as illustrated in FIGS. 16A and 16B, that is used to provide a coupling between the wire ports 50 and 52 and the electrical contacts of the source of light 10. In some instances, the circuit board 54 could be provided with circuitry for use in regulating/conditioning power to and/or otherwise controlling operation of (e.g., to provide dimming of) the source of light 10. Yet further, the circuit board 54 could include contacts 56 for directly, electrically linking the circuit board 54 to the electrical contacts of the source of light 10. If such a circuit board 54 is utilized, a cover 58 may be provided to protect the circuit board 54 which cover 58 may include openings leading to the wire ports 50, 52. In the case where the light source holding component 12 is provided with wire ports for both power 50 and control 52, it may also be desired to make the openings for the wire ports 52, which are used to receive the control wires, smaller than the opening of the wire ports 50, which are used to receive the power wires, to thereby prevent an installer from installing power wires into the control wire ports 52 by accident (as power wires are generally of larger gauge). Further, in the case where the light source holding component 12 is provided with wire ports for both power 50 and control 52, it may be desired to provide the heat sink with wire passages for both the power wires and control wires as illustrated in FIG. 15.

Turning now to FIGS. 20-23, 24A, 24B, and 25-28, a further assembly is illustrated which includes the components previously described, e.g., a light source holding component 12 for holding a source of light 10, a heat sink 14, a junction box 16, and a can enclosure 20, wherein the light source holding component is provided with an accessory mounting feature for use in mounting an accessory 60. The accessory 60 can be, without limitation, a holding component which is usable to mount one or more lenses, a metal housing for applications where a metal enclosure for the lamp holder is required, etc. The accessory 60 may be further adapted to cooperate with the accessory mounting feature of the light source holding component 12 to provide a seal for protecting the electrical components associated with the light source holding component 12 and the source of light 10 held therein from dust, moisture, or the like. To this end, the accessory 60 is sized and arranged to fit over the light source holding component 12, for example by being twist fit thereto, and to cooperate with the accessory holding feature to thereby seal against a surface upon which the light source holding component 12 is attached, in this example the heat sink 14. Thus, the accessory 60 is provided with a housing 62 having opposed sides 63, 64 one of which is sized to accept and engage with the light source holding component 12 and the other of which provides an opening or other optical feature through which light from the source of light 10 is emitted.

Figure 23:
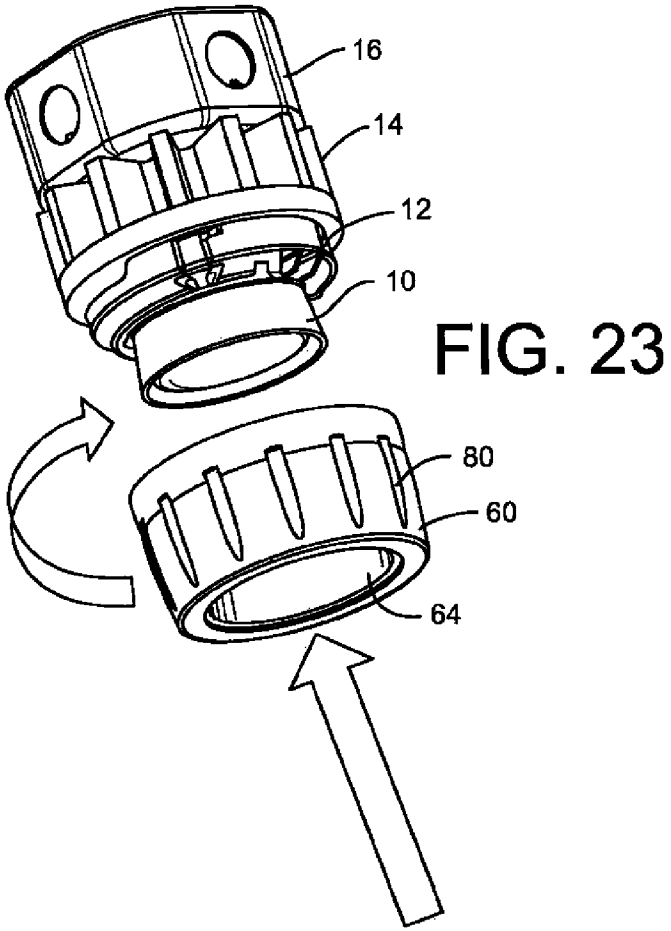
Figure 22:
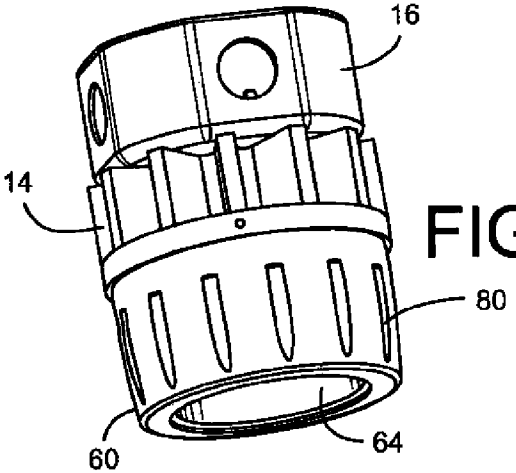
Figure 24B:
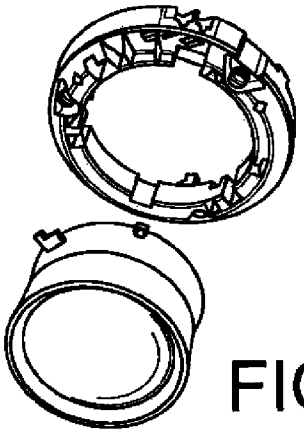
FIG. 24B illustrates a light source holding component without a source of light installed therein constructed according to the description that follows.
Figure 24A:
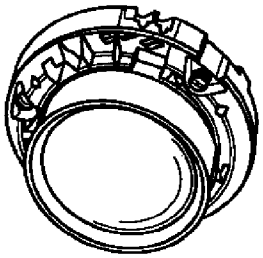
FIG. 24A illustrates a light source holding component with an installed source of light constructed according to the description that follows.
Figure 28:
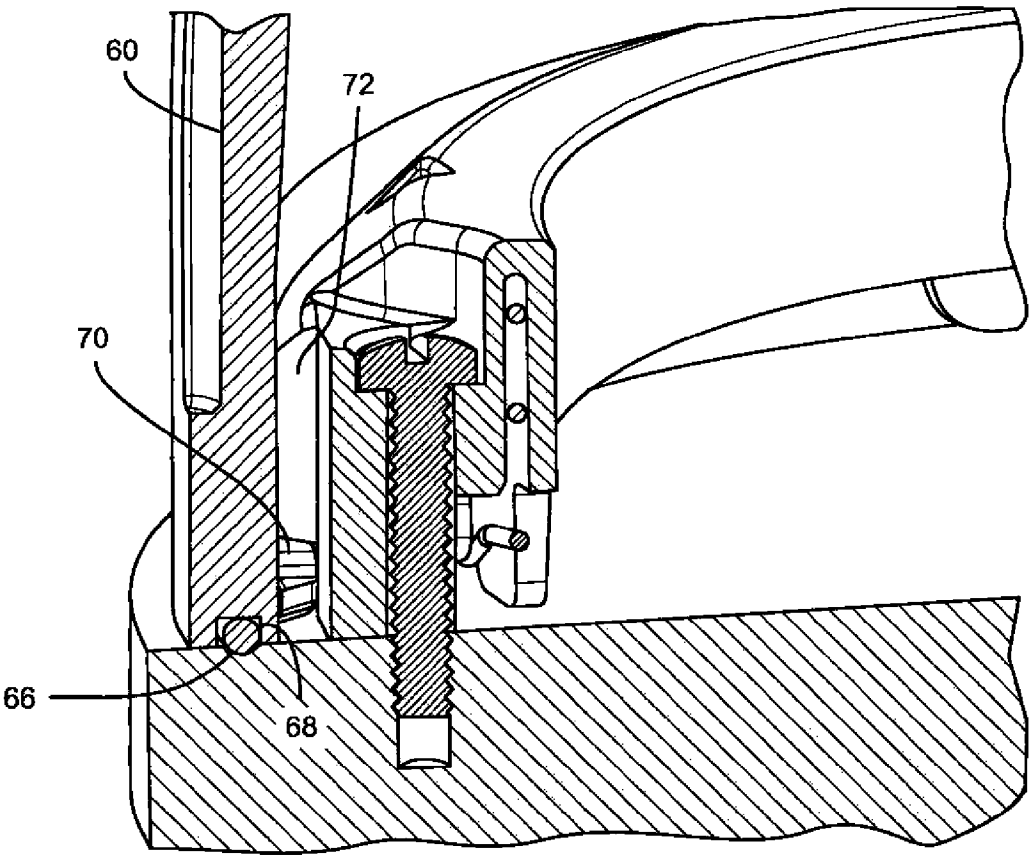
FIG. 28 illustrates a cross-sectional view of a light source holding component and an accessory constructed according to the description that follows attached to a heat sink.

To assemble the components when accessory 60 is included, the source of light 10 is secured within the light source holding component 12 as shown in FIG. 24A and, thereafter, the accessory 60 is positioned over the light source holding component 12 and the source of light 10 whereby the accessory 60 will enclose the light source holding component 12 and source of light 10 therein as shown in FIGS. 22 and 23. To provide the protective seal noted above, when the accessory 60 is installed upon the light source holding component 12, a seal 66 associated with the accessory 60 will mate with the surface upon which the light source holding component 12 is installed, e.g., the heat sink 14. The seal 66 associated with the accessory 60 may be provided by an O-ring positioned within a groove 68 formed in the edge of the accessory 60 adjacent to the opening 63 as shown in FIGS. 26 and 28 or via the use of other sealant materials as needed for any particular application.

Figure 26:
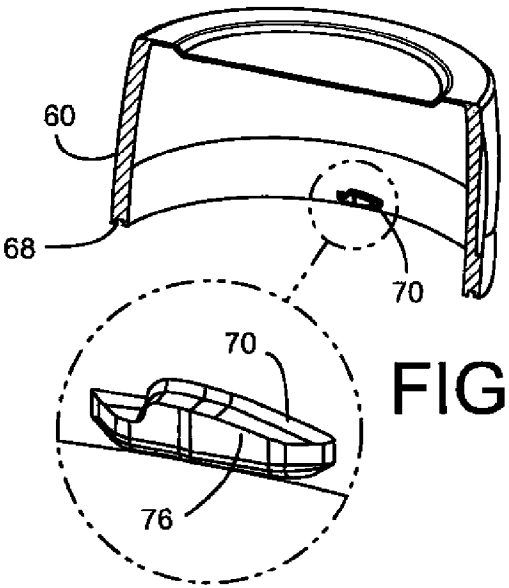
FIGS. 25 and 26 illustrate an exemplary locking tab of an accessory adapted to cooperate with the accessory mounting feature of a light source holding component constructed according to the description that follows.
Figure 25:
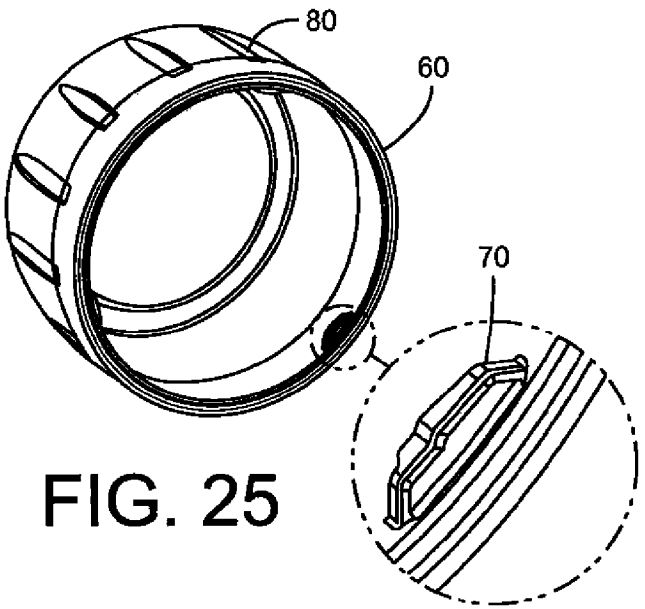
Figure 27:
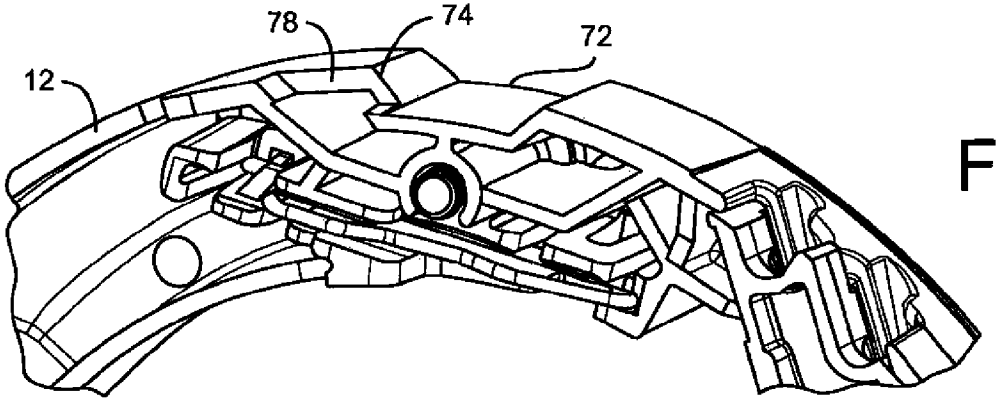
FIG. 27 illustrates an exemplary locking slot associated with the accessory mounting feature of a light source holding component constructed according to the description that follows.

For attaching the accessory 60 to the light source holding component 12, the accessory 60 is provided with locking tabs 70, which are positioned so as to extend inwardly from an interior surface of the accessory 60 adjacent to the opening 63 as shown in FIGS. 25 and 26. The locking tabs 70 are sized and arranged to fit within complimentary lock receiving recesses 72 associated with the accessory holding feature of the light source holding component 12 as shown in FIG. 27. In the exemplary case where the accessory 60 is to be twist fit to the light source holding component 12, the lock receiving recesses 72 are provided with locking slots 74 into which the locking tabs 70 are to be positioned after being inserted into the lock receiving recesses 72. The locking tabs 70 may additionally be provided with a ramped surface 76 which will function to drive the accessory 60 against the surface carrying the light source holding component 12 as the locking tabs 70 are turned under surfaces 78 of the locking slots 74. The surfaces 78 could also be ramped for this same purpose. As will be appreciated, by causing the accessory 60 to be driven against the surface carrying the light source holding component 12 through use of the ramped surfaces 76 or equivalent, engagement between the seal 66 and the surface carrying the light source holding component 12 is ensured. In other embodiments, this locking arrangement could be achieved by providing the accessory holding feature of the light source holding component 12 with outwardly extending, similarly arranged locking tabs with the accessory 60 then being provided with complimentary receiving recesses and slots. While not required, the accessory 60 may be provided with raised gripping surfaces 80 to facilitate the twisting of the accessory 60 between a locked and an unlocked position relative to the light source holding component 12.

Figure 30:
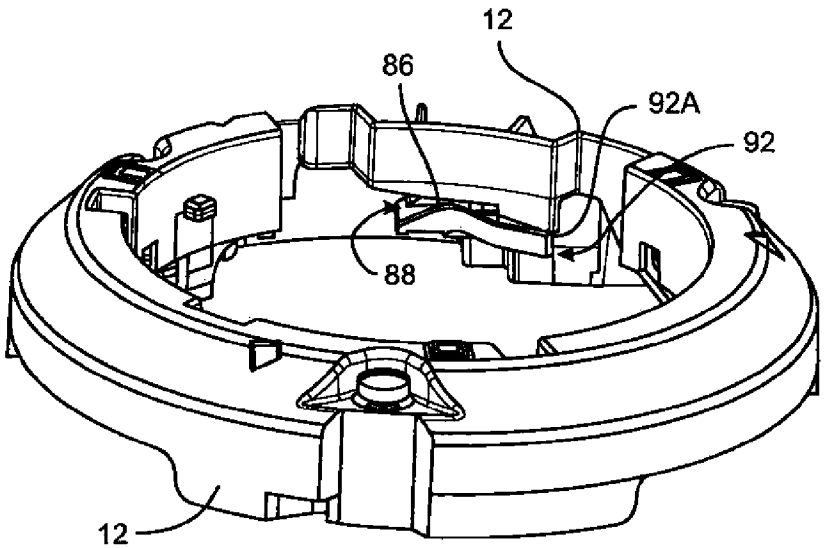
FIGS. 29 and 30 illustrate a light source holding component having touch safe protection characteristics constructed according to the description that follows.
Figure 29:
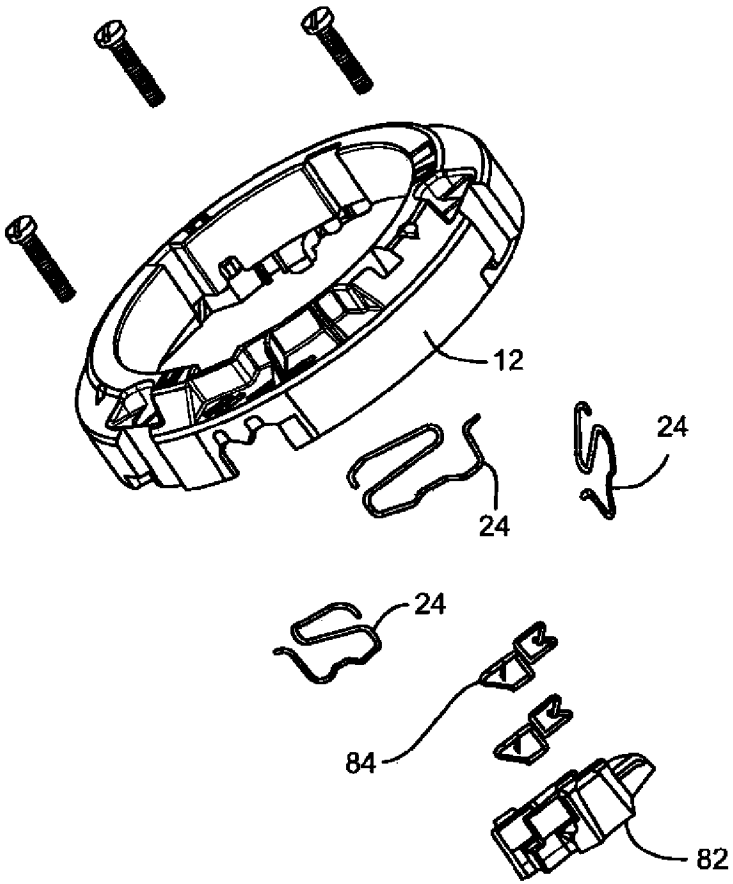
Figure 31:
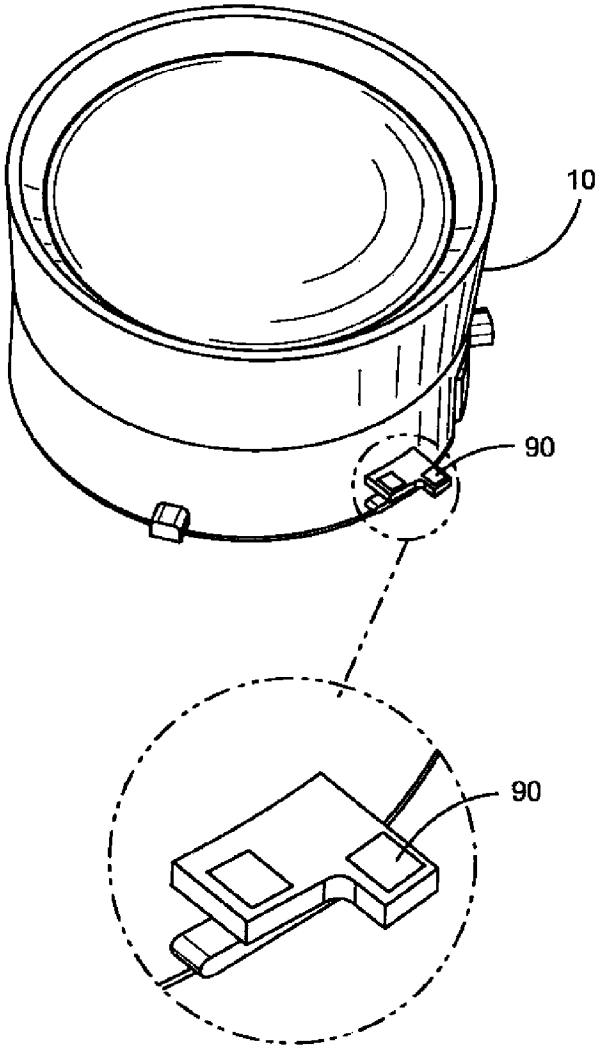
FIG. 31 illustrates an exemplary source of light insertable into a light source holding component constructed according to the description that follows.

Turning now to FIGS. 29 and 30, a further exemplary light source holding component 12 is illustrated which includes a terminal holder device 82 that functions to carry electrical terminals 84 which are arranged to engage with corresponding electrical contacts associated with the source of light 10. In the exemplary source of light 10, shown in FIG. 31, the electrical contacts are disposed upon contact carrying areas 90.

To protect against an accidental touching of the electrical terminals 84, e.g., by a finger, the electrical terminals 84 are further carried on the light source holding component 12 behind a protective device 86. More particularly, the protective device 86 generally functions to block radial access to a cavity 88 in which the electrical terminals 84 are positioned and exposed, i.e., the protective device 86 covers at least a portion of the cavity 88 in the radial direction. Thus, to allow the electrical terminals 84 to be placed into engagement with the electrical contacts associated with the source of light 10 despite the inclusion of the protective device 86, the protective device 86 is preferably arranged to be displaceable when the source of light 10 is installed within the light source holding component 12. To this end, the protective device 86 is preferably formed as a resilient, finger-like element that is attached at one end thereof 92 to the body of the light source holding component 12, e.g., by radial extending portion 92*a*, and which is thereby displaceable at the other end thereof away from the cavity 88, e.g., in an axial direction and/or in a radial direction, when the electrical contact areas 90 of the source of light 10 are moved into the slot 88 during a twisting installation of the source of light 10 into the light source holding component 12.

Figure 32A:
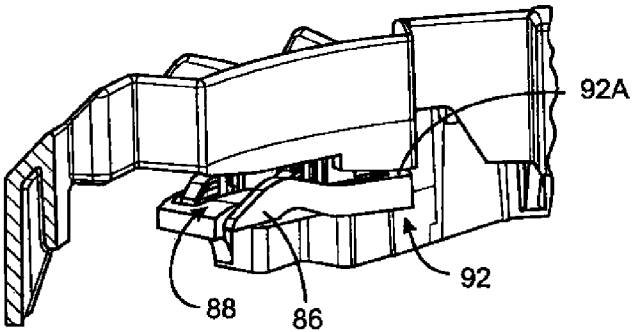
FIGS. 32A-32C illustrate a method by which a source of light is installed within a light source holding component constructed according to the description that follows.
Figure 32B:
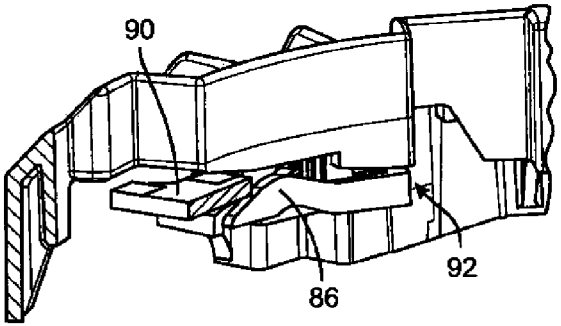
Figure 32C:
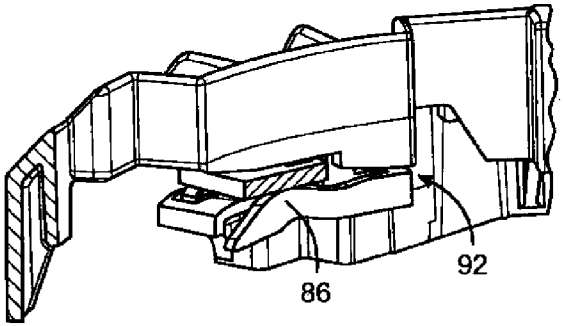

To facilitate the displacement of the protective device 86, and thereby allow the electrical contact areas 90 of the source of light 10 to be easily positioned within the slot 88, the protective device 86 may be provided with ramped surfaces 94 as shown in FIGS. 32A-32C. As will be appreciated, the ramped surfaces 94 will be arranged and configured to be engageable with the underside surface of the contact areas 90 as the source of light 10 is twisted into position within the light source holding component 12. As a result of such arrangement, during the twisting installation of the source of light 10 into the light source holding component 12 the contact area 90 will force the protective device 86 to be displaced away from the slot 88 generally in an axial direction, e.g., as viewed in the figures the protective device would be caused to rotate downwardly in a counter-clockwise direction about attachment 92. When the source of light 10 is removed from the light source holding component 12, the protective device 88 will spring back into its blocking position. The protective device 86 could also be arranged so as to be driven outwardly away from the slot 88. To this end, an inwardly disposed, side surface of the protective device 86 (which could also be ramped) would be arranged and configured to engage with the outer, side surface of the contact area 90 as the source of light 10 is twisted into position within the light source holding component 12. As a result of such arrangement, during the twisting installation of the source of light 10 into the light source holding component 12 the contact area 90 would force the protective device 86 to be displaced away from the slot 88 in a radial direction, e.g., as viewed in the figures the protective device would be caused to rotate outwardly in a counter-clockwise direction about attachment 92. Again, the protective device 86 would be designed to spring back into its blocking position when the source of light 10 is removed from the light source holding component 12.

While specific embodiments of the subject invention have been described in detail, it will be appreciated by those skilled in the art that various modifications and alternatives to those details could be developed in light of the overall teachings of this disclosure. For example, it is to be appreciated that features described with respect to the various embodiments are not to be limited to any particular embodiment but may be freely used across embodiments where applicable. Additionally, it will be appreciate that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof.

What is claimed is:

1. A device, comprising:

a light source holding component having a hole providing an interior surface that is sized and arranged to cooperate with a corresponding exterior surface of a source of light to thereby releasably secure the source of light within the light source holding component and a first wire port passageway extending into the light source holding component from an opening formed in an exterior surface of the light source holding component that is opposite to the interior surface of the light source holding component; and an electrical contact disposed within the first wire port passageway for providing an electrical coupling between the source of light when secured within the light source holding component and an electrical wire when coupled to the electrical contact within the first wire port passageway;

wherein the first wire port passageway is arranged to extend into the light source holding component from the opening formed in the exterior surface of the light source holding component in a direction that is tangential to a circle positioned in its entirety between the interior surface of the light source holding component and the exterior surface of the light source holding component.

2. The device as recited in claim 1, comprising a wire pre-attached to the electrical contact within the first wire port passageway and extending outwardly from the exterior surface of the light holding component.

3. The device as recited in claim 1, wherein a portion of the exterior surface of the light source holding component adjacent to the opening of the first wire port passageway has a curved edge.

4. The device as recited in claim 1, wherein the exterior surface of the light source holding component comprises one or more channels formed therein to provide a fluid connection between a base of the source of light and air external to the light source holding component.

5. The device as recited in claim 4, wherein the channels extend to the interior surface of a heat sink to which is attached the light source holding component.

6. A device, comprising:

a heat sink having a first surface adapted to be attached to an underside of a light source holding component that is sized and arranged to securely receive a source of light and associated with one or more wire port passageways and a second surface opposite the first surface having a plurality of heat-dissipating fins extending therefrom;

wherein at least one of the plurality of heat-dissipating fins of the heat sink comprises one or more integrally formed wire passages arranged to extend through the at least one of the plurality of heat-dissipating fins from a first opening formed on an external surface of the at least one of the heat-dissipating fins to second opening that is formed on the first surface of the heat sink so as to be positioned adjacent to the one or more wire port passageways of the light source holding component.

7. The device as recited in claim 6, wherein the first surface of the heat sink positionable adjacent to the light source holding component is recessed to provide access to the one or more integrally formed wire passages.

8. A device, comprising:

a heat sink having a first surface adapted to be attached to an underside of a light source holding component that is sized and arranged to securely receive a source of light and associated with one or more wire port passageways and a second surface opposite the first surface having a plurality of heat-dissipating fins extending therefrom;

wherein the first surface has one or more integrally formed wire passages arranged to extend through the first surface of the heat sink fins from a first opening to second opening that is formed on the first surface of the heat sink so as to be positioned adjacent to the one or more wire port passageways of the light source holding component and wherein the plurality of heat-dissipating fins are arranged to form a junction box cavity and the junction box cavity is in communication with the first opening of the one or more integrally formed wire passages.

9. A device, comprising:

a light source holding component having a hole providing an interior surface that is sized and arranged to securely receive a source of light, one or more first wire port passageways extending into the light source holding component from an opening formed in an exterior surface of the light source holding component for receiving wires used to provide power to the source of light, and one or more second wire port passageways extending into the light source holding component from an opening formed in the exterior surface of the light source holding component for receiving wires used to provide control signals for controlling the source of light wherein the one or more second wire port passageways for receiving wires used to provide control signals are sized smaller than the one or more first wire port passageways for receiving wires used to provide power to the source of light.

10. The device as recited in claim 9, wherein the one or more first wire port passageways for receiving wires used to provide power and the one or more second wire port passageways for receiving wires used to provide control signals have electrical connectors of the push-in type for receiving and thereupon holding wires inserted therein.

* * * * *